US011097285B2

(12) United States Patent
Kuhn

(10) Patent No.: US 11,097,285 B2
(45) Date of Patent: Aug. 24, 2021

(54) CRANKCASE VENTILATION MANAGEMENT DEVICES, SYSTEMS, AND METHODS

(71) Applicant: Kuhn Performance Technologies LLC, Cold Spring, KY (US)

(72) Inventor: John William Kuhn, Cold Spring, KY (US)

(73) Assignee: Kuhn Performance Technologies, LLC, Cold Spring, KY (US)

( * ) Notice: Subject to any disclaimer, the term of this patent is extended or adjusted under 35 U.S.C. 154(b) by 146 days.

(21) Appl. No.: 16/012,277

(22) Filed: Jun. 19, 2018

(65) Prior Publication Data

US 2019/0210039 A1 Jul. 11, 2019

Related U.S. Application Data

(60) Provisional application No. 62/616,231, filed on Jan. 11, 2018.

(51) Int. Cl.

| | |
|---|---|
| ***B04B 5/00*** | (2006.01) |
| ***F01M 13/04*** | (2006.01) |
| ***B04B 15/02*** | (2006.01) |
| ***B04B 13/00*** | (2006.01) |
| ***B04B 5/12*** | (2006.01) |
| ***B04B 7/16*** | (2006.01) |

(52) U.S. Cl.

CPC ..... *B04B 5/005* (2013.01); *B04B 5/12* (2013.01); *B04B 7/16* (2013.01); *B04B 13/00* (2013.01); *B04B 15/02* (2013.01); *F01M 13/04* (2013.01); *B04B 2005/125* (2013.01); *F01M 2013/0422* (2013.01)

(58) Field of Classification Search

CPC .. B04B 5/005; B04B 5/12; B04B 7/16; B04B 15/02; B04B 13/00; B04B 2005/125; F01M 13/04; F01M 2013/0422

See application file for complete search history.

(56) References Cited

U.S. PATENT DOCUMENTS

| | | | | |
|---|---|---|---|---|
| 3,712,032 A | | 1/1973 | Obligado | |
| 5,277,154 A | * | 1/1994 | McDowell | B01D 45/06 123/41.86 |
| 5,411,142 A | * | 5/1995 | Abbott | B07B 4/02 209/139.1 |
| 6,709,476 B2 | | 3/2004 | Kitano et al. | |
| 7,309,308 B2 | | 12/2007 | Berger et al. | |
| 7,717,101 B2 | | 5/2010 | Beetz et al. | |
| 8,152,887 B2 | | 4/2012 | Patel | |
| 8,388,713 B2 | | 3/2013 | Enderich et al. | |
| 8,673,038 B2 | | 3/2014 | Tornblom | |
| 8,695,339 B2 | | 4/2014 | Spix | |
| 8,726,876 B2 | | 5/2014 | Kobayashi et al. | |

(Continued)

FOREIGN PATENT DOCUMENTS

| | | | | |
|---|---|---|---|---|
| CN | 1931441 A | * | 3/2007 | B04B 13/00 |
| JP | 2009243268 A | * | 10/2009 | |

(Continued)

*Primary Examiner* — Jacob M Amick
*Assistant Examiner* — Charles J Brauch
(74) *Attorney, Agent, or Firm* — Wood Herron & Evans LLP

(57) ABSTRACT

A centrifugal separator for separating blow-by gases into cleaned air and liquid for recirculation through an engine.

12 Claims, 15 Drawing Sheets

(56) References Cited

U.S. PATENT DOCUMENTS

| | | | | |
|---|---|---|---|---|
| 2003/0106292 | A1 | 6/2003 | Kitano et al. | |
| 2004/0000236 | A1 | 1/2004 | Linnersten et al. | |
| 2007/0149378 | A1* | 6/2007 | Takahashi | B04B 13/00 494/1 |
| 2007/0249479 | A1* | 10/2007 | Eliasson | B04B 5/12 494/43 |
| 2010/0147153 | A1 | 6/2010 | Patel | |
| 2012/0285425 | A1 | 11/2012 | Spix | |
| 2013/0008420 | A1 | 1/2013 | Spix et al. | |
| 2013/0049364 | A1* | 2/2013 | Teets | G08G 1/0129 290/45 |
| 2013/0075329 | A1* | 3/2013 | Culler | B01D 61/145 210/607 |
| 2016/0031542 | A1* | 2/2016 | Yin | G05B 15/02 700/282 |

FOREIGN PATENT DOCUMENTS

| | | | | |
|---|---|---|---|---|
| WO | WO-9620097 | A1 * | 7/1996 | B60H 3/0658 |
| WO | WO-2009116897 | A1 * | 9/2009 | B01D 45/14 |
| WO | WO-2015128925 | A1 * | 9/2015 | B04B 5/12 |

* cited by examiner

CRANKCASE VENTILATION MANAGEMENT DEVICES, SYSTEMS, AND METHODS

I. CROSS REFERENCE

This application claims the benefit of U.S. Patent Application No. 62/616,231, filed Jan. 11, 2018, the entirety of which is incorporated by reference herein.

II. BACKGROUND

Field

This disclosure generally relates to devices, systems, and methods for processing engine blow-by gases, such as by separating oil from the gases and returning the gases, and/or oils to the engine.

Certain Related Art

Many piston-driven internal combustion engines that see rigorous use, and/or create large amounts of power generate blow-by gases. Blow-by gases are the result of gases leaking past seals (e.g., piston rings, valve guides, and/or valve seals) in the engine and into the crankcase. The blow-by gases flow through the crankcase and eventually escape through the engine's crankcase breathing system. For example, in many cases, the blow-by gases escape the engine by traveling down channels made to drain oil from the cylinder heads. The blow-by gases typically pick-up oil and oil vapor as they pass through the crankcase. The gases may also pick up oil from the piston rings, valve guides, valve seals, and/or cylinder walls as they leak from the combustion chambers (e.g., cylinders).

III. SUMMARY OF CERTAIN FEATURES

Various embodiments of this disclosure relate to processing engine blow-by gases, such as by separating a liquid portion (e.g., water and oil) from an air portion. In various embodiments, the separated air and liquid portions are returned to the engine. The embodiments can be particularly beneficial for modern engines. Compared to engines of the past, modern engines allow for much higher cylinder pressures due to combustion chamber design and engine management. For example, the modern direct injection gasoline engines can run much higher manifold pressures along with compression ratios that would have damaged or destroyed an engine which was state of the art 15 years ago. Higher cylinder pressures in the engine can result in more blow-by gases and more oil being picked up by the blow-by gases, thereby increasing the need for processing of such gases. Moreover, some smaller modern engines have the ability to make additional power on demand through higher cylinder pressure, by way of higher compression ratios and/or positive manifold pressure, which furthers the need to properly process the blow-by gases. Supercharged or turbocharged engines, in particular, can have problems with blow-by gases because such engines typically run with higher internal pressures and create pressures in the intake and/or exhaust manifolds. Supercharged and/or turbocharged engines are prone to having gases leak past the piston rings, intake valve guides, intake valve seals, and/or the exhaust valve guides and seals at a heightened rate as compared to their normally aspirated counterparts.

In most internal combustion engines, the blow-by gases are directed out of the crankcase and back into the intake system to be burned in the combustion chamber. Emissions regulations mandate this as law. However, the amount of blow-by, and/or the amount of oil carried by the blow-by gases, may be too excessive to introduce back into the intake system without negative consequences. Excessive oil can, for example, lower fuel octane that promotes detonation which can severely damage engine parts. In an attempt to address this concern, some engines direct the blow-by gases through a filter that separates the oil into a collection container and lets the gases vent to atmosphere. This can be a messy, inefficient, and/or illegal method to deal with blow-by gases. The collection container needs to be emptied regularly (or risk overflowing) and the smell of the gases and oils can typically be detected in the vehicle's passenger compartment.

In carbureted or traditional style fuel injected (e.g. throttle body or port style) engines, during operation, fuel spray is continually spraying into the intake manifold. This fuel washes oil deposits off of the intake manifold and air intake valves. However, many modern engines have fuel delivery systems that inject fuel straight into the cylinder head, rather than the intake manifold. Because emissions laws mandate that crankcase gases be re-ingested into the intake track, these gases (including the oil mist in the gases) enter the intake manifold and pass by the relatively hot intake valves. Because fuel is not being sprayed in the intake manifold, oil deposits can quickly form on the intake valves and in the intake runners. This can result in loss in performance, decreased efficiency, and/or increased maintenance. For example, the intake may need to be removed and all the ports cleaned at a relatively low number of miles (e.g., 50,000 miles). This can incur substantial expense to remove, clean, and reseal the intake, as well as inconveniently place the vehicle out of service.

Previous attempts to address the issue of blow-by gases inadequately processed (e.g., cleaned) by the blow-by gases, required excessive maintenance or replacement of parts, encourage circumvention of legal environmental requirements, and/or provided limited engine configuration options (for either after-market or manufacturer solutions). In the aircraft industry, it was common to direct blow-by gases outside the fuselage, which would often leave oil residue on the side of the aircraft. A flawed solution was to pass the blow-by gases through a filter tube that included an inner tube inside of a larger tube with several layers of screen wrapped around the inner tube in order to filter the oil out of the air. The collected oil could drain separately out of the tube from the filtered gases. This approach is generally too inefficient for a modern high performance engine and/or leaves too much oil in the gases directed to the intake. For example, the screens can become clogged, requiring regular cleaning and/or replacement of the filter tube.

Another flawed solution included a device having a built-in pop-off valve, replaceable filter media, and easy access cap. This device was typically for use in turbocharged diesel applications where the engine runs a large portion of time in positive manifold pressure. This approach is generally too inefficient for a modern high performance engine and requires frequent maintenance and replacement of the filter media. For example, the blow-by gases passing through the device are cleaned by passage through the filter media. The filter media, however, can become an air restriction point as it fills and becomes clogged with oil and particulate deposits. An additional drawback is the physical size of such devices.

A further flawed attempt to address the problem of blow-by gases was a catch-can. The catch-can directs the blow-by gases through a filter media and/or screens that remove the oil. The oil is gathered in a simple can that can be removed and emptied. In some situations, the catch can is left open to the atmosphere, which can violate emissions laws and can emit a foul odor. The filter media and/or screens can become clogged, thereby requiring regular cleaning and/or replacement of the catch-can or components thereof.

This disclosure describes various devices, systems, and methods that address and/or improve upon at least some of the above-mentioned problems, or others.

Several embodiments comprise a centrifugal separator. In some implementations, compared to the aforementioned flawed devices, the centrifugal separator cleans a higher volume of gas and/or is more effective at removing oil from the blow-by gases. The centrifugal separator can be used in a proper and/or legally compliant method including cleaning the blow-by gases and sending them back to the intake system and recycling the oil by allowing it to drain or be pumped back into the oil reservoir of an engine.

In some implementations, a centrifugal separator can operate with minimal maintenance. For example, the centrifugal separator can operate and clean blow-by gases without requiring replacement of filtration rings, filters, and/or manual emptying of a catch container for separated oil. In some embodiments, the cleaned gas from the centrifugal separator does not have to pass through a filter, which can reduce or eliminate clogging and/or creating an air restriction that negatively affects performance.

In some implementations, a centrifugal separator can comprise a centrifugal assembly. The centrifugal assembly can include a plurality of discs. The blow-by gases can be routed over the surfaces of the plurality of discs and/or between adjacent discs while the discs are rotating at high speed. Oil and/or water vapor in the blow-by gases can coalesce on the surfaces of the discs. Once coalesced on the moving discs, the rotational motion of the discs can eject the coalesced oil onto the sides of a housing of the centrifugal separator and/or onto a wicking material lining the sides of the housing. The oil and/or water can drip under the force of gravity through the wicking material to a bottom of the centrifuge. The oil and/or water can collect at the bottom of the housing. The oil and/or water can be removed from the housing through a liquid outlet. The liquid outlet can connect with an oil duct linking the housing with an oil reservoir and/or the crankcase of an engine. The oil and/or water can return to the engine via the duct. In some implementations, a pump can be used for moving the oil and water from the housing and through the oil duct into the crank case. In certain embodiments, the centrifugal separator continuously cleans blow-by gases during operation of the engine. In some variants, the centrifugal separator intermittently cleans blow-by gases during operation of the engine (e.g. based on load).

In certain implementations, the centrifugal separator can be installed in an engine bay of a vehicle. However, due to the reduced size of engine bays in modern cars, it can be difficult to install an aftermarket air/oil separator in the engine bay. Some embodiments of the centrifugal separator are configured to be placed in a different location around and within the engine bay, thereby providing flexibility in the installation location and enabling installation in a wider variety of vehicle types. In some installations arrangements, the centrifugal separator can be located above a crankcase or oil reservoir of the engine. In some implementations, this installation arrangement allows for separated oil and water within the centrifugal separator to be fed by gravity back into the oil reservoir. The centrifugal separator can be a stand-alone device that is connected to, but separate from, the engine.

Some embodiments of the centrifugal separator are configured to be placed outside of the engine bay. For example, some embodiments are configured to be located under a bumper cover or fender of the vehicle. In some installation arrangements, the centrifugal separator can include a pump for delivering the separated oil and water from centrifugal separator into the oil reservoir of the engine. This enables the centrifugal separator to be placed lower than the oil reservoir and/or at a low position within or around an engine bay, for example, in a fender region of the vehicle.

In some implementations, the centrifugal separator can be powered by an electric motor. The electric motor can provide additional flexibility for placement of the centrifuge within the engine bay of the vehicle. The motor and/or the pump or other electric components of the centrifuge can be powered through the alternator and/or the battery of the vehicle. Some variants are powered by a power take off shaft from the engine.

In some implementations, the centrifugal separator can be used in conjunction with a turbocharged diesel engine, normally aspirated gasoline engine, or turbo or supercharged gasoline engine. These implementations include but are not limited to; 4-stroke and 2-stroke cycle engines of piston, rotary (e.g. Wankel), or other mechanical style internal combustion engines.

In some implementations, operation of the centrifugal separator can be customizable. The centrifugal separator can include a user interface for setting conditions for operating the centrifugal separator and/or pump thereof. The user interface can be through a computer, smart phone, or other input device that interfaces with a controller on the centrifugal separator. The controller can operate the motor and/or the pump. The user can select an operational parameter related to the engine as a trigger condition for the operation of the centrifuge. Operational parameters can include the engine speed, the manifold air pressure, a timer (e.g., a running time of the engine), or any variable from the on-board diagnostics system (OBD) of the engine.

In some implementations, continued operation of the centrifugal separator can be based on monitoring of the operational parameter and/or a second operation parameter. The second operational parameter can be any of the above-mentioned operational parameters, a temperature of the centrifugal separator, or other operational parameter.

The foregoing summary is illustrative only and is not intended to be limiting. Other aspects, features, and advantages of the systems, devices, and methods and/or other subject matter described in this application will become apparent in the teachings set forth below. The summary is provided to introduce a selection of some of the concepts of this disclosure. The summary is not intended to identify key or essential features of any subject matter described herein.

IV. BRIEF DESCRIPTION OF THE DRAWINGS

Various embodiments are depicted in the accompanying drawings for illustrative purposes, and should in no way be interpreted as limiting the scope of the embodiments. Various features of different disclosed embodiments can be combined to form additional embodiments, which are part of this disclosure.

V. DETAILED DESCRIPTION OF CERTAIN EMBODIMENTS

The various features and advantages of the systems, devices, and methods of the technology described herein will become more fully apparent from the following description of the embodiments illustrated in the figures. These embodiments are intended to illustrate the principles of this disclosure, and this disclosure should not be limited to merely the illustrated examples. The features of the illustrated embodiments can be modified, combined, removed, and/or substituted as will be apparent to those of ordinary skill in the art upon consideration of the principles disclosed herein.

A. Blow-By Gases

Figure 1:
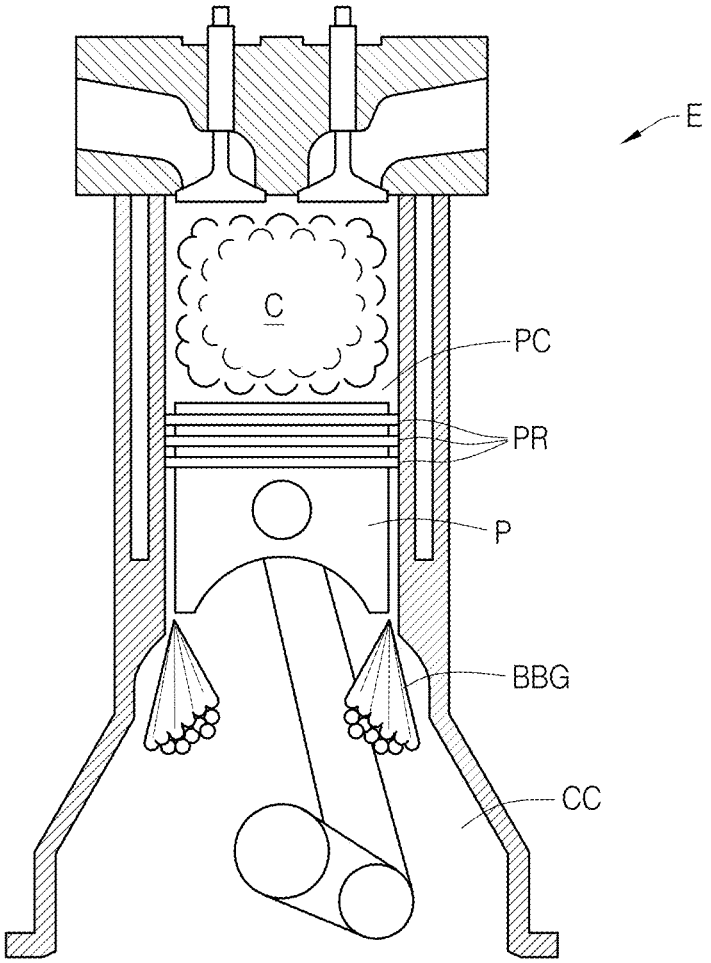
FIG. 1 is a cross-section of a cylinder of an internal combustion 4-stroke piston engine and shows blow-by gases escaping from the cylinder.

FIG. 1 illustrates the escape of blow-by gases BBG from a piston cylinder PC in an internal combustion engine E. Blow-by gases can include gases that escape from within the cylinder such as during the combustion C of fuel and the expansion of the cylinder by moving a piston P. The cylinder can be sealed by piston rings PR attached to the piston and engaged with a wall of the piston cylinder. However, due to high pressure and/or worn seals or other defects in the system, some of the gases during or after combustion can escape from the cylinder. These blow-by gases can escape around the piston rings and/or around faulty valve stems or valve seals. The blow-by gases can escape into the crankcase CC of the engine. From here, the accumulation of blow-by gases can create a positive pressure relative to atmospheric pressure and the blow-by gases will eventually leak to the ambient environment. This leakage includes taking pathways outside of the crankcase through valves, seals, or other routes.

The blow-by gases can include an air portion and a liquid portion. The liquid can include, for example, oil vapor or particles, fuel vapor (e.g. hydrocarbons), exhaust gasses, and/or water vapor. The liquid portion can comprise aerosolized liquid. This liquid can be an environmental hazard. In some jurisdictions, environmental regulations require that blow-by gases be gathered and maintained internally within the engine. In some implementations, the blow-by gases (including the liquid) are routed back into the intake manifold and passed back into the combustion chamber. While this can provide an adequate solution for certain engines, other engines, such as direct fuel injection engines, can be adversely affected by the presence of the oil in the blow-by gases. For example, the oil can deposit on the valves controlling the inlet and outlet of the gases into the cylinder. The abundance of oil in the blow-by gases can affect the octane levels in the fuel and lead to premature combustion, otherwise known as engine knock, which degrades performance and can cause damage. The greater degree of stress and rigor that the engine is subject to can lead to increased creation of blow-by gases and further performance degradation. This can be especially the case where high pressures of gases into the intake manifold and combustion chamber are utilized, since such high pressures generally increases the volume of blow-by gases and/or the amount of liquid rerouted back into the intake manifold.

B. Centrifugal Separator System

FIGS. 2-8C illustrate an embodiment of a centrifugal separator 100. As described in more detail below, the centrifugal separator 100 can be configured to receive and process some or all of the blow-by gases generated by the engine. For example, the centrifugal separator 100 can be configured to separate the blow-by gases into air and oil portions.

Figure 2A:
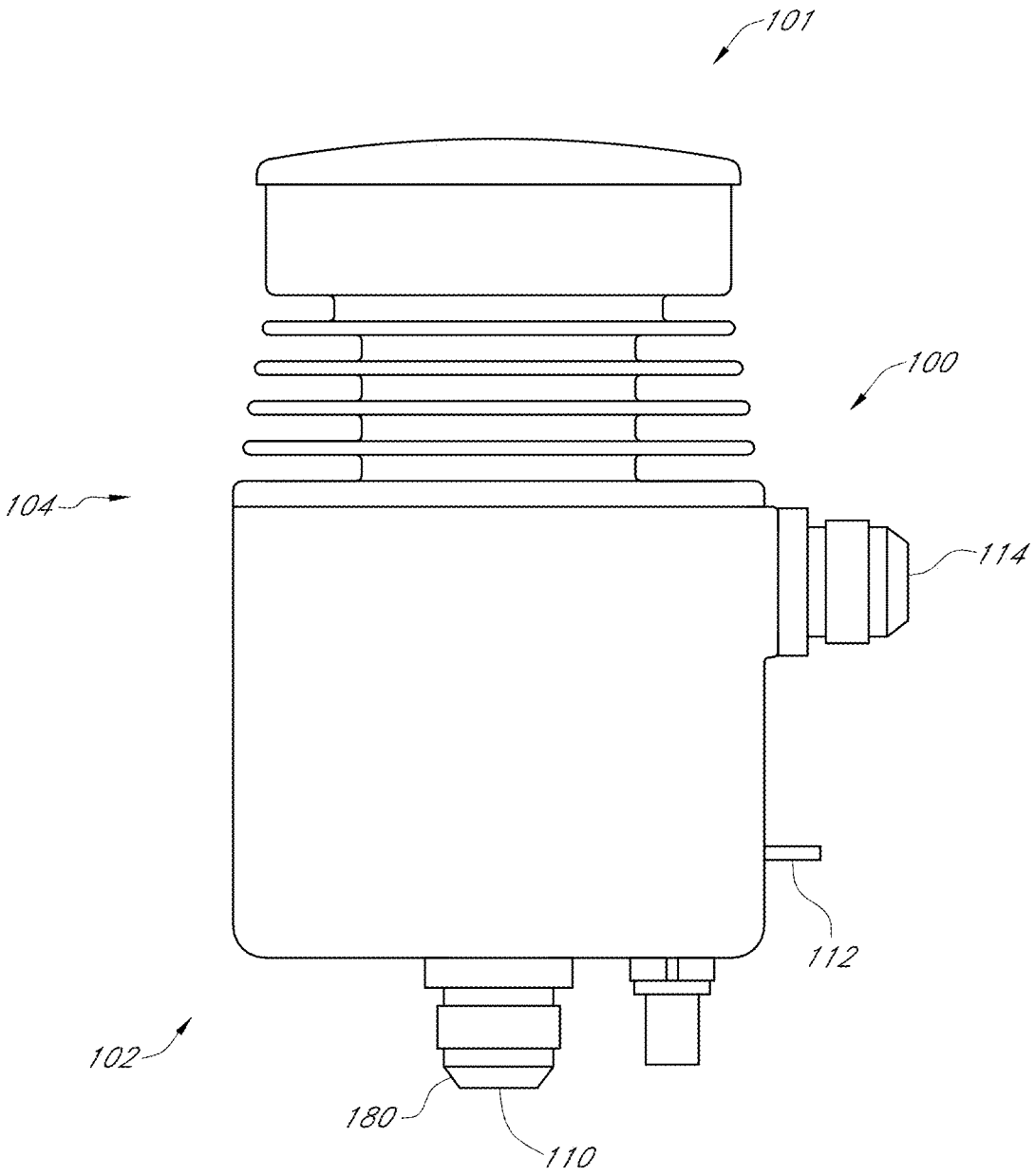
FIG. 2A is a side view of a centrifugal separator.
Figure 2B:
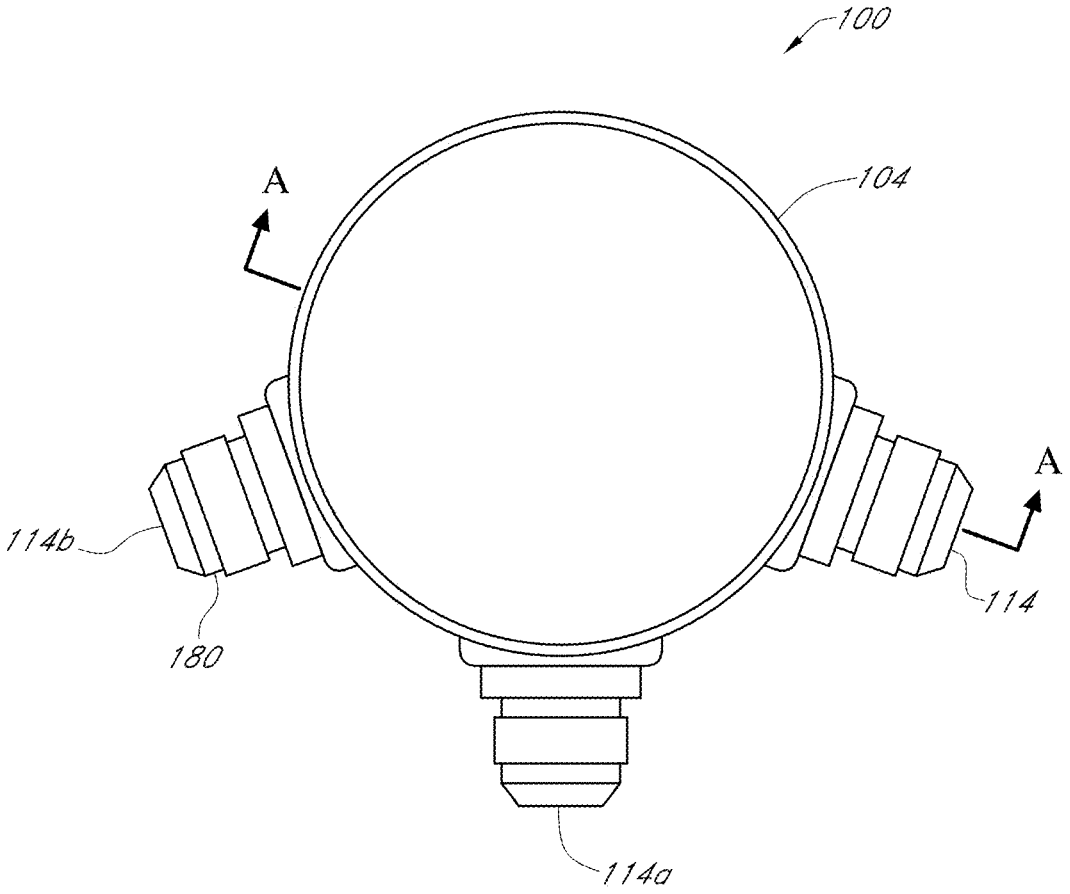
FIG. 2B is a top view of the centrifugal separator of FIG. 2A.

As shown in FIGS. 2A and 2B, the centrifugal separator 100 can include a housing 104. The housing 104 can be generally cylindrical, although the shape on both an interior and exterior side of the housing 104 is not limited to being cylindrical. The housing 104 can contain one or more hollow spaces disposed therein for housing and providing structural support and protection to any internal components of the centrifugal separator 100. The housing 104 can provide mounting locations for assembling the centrifugal separator 100 within an engine bay of a vehicle or other use environment. In some implementations, the housing 104 can be formed of steel, aluminum, a polymer, or other suitable material. The housing 104 can be formed according to conventional manufacturing processes such as, but not limited to, machining, casting, forging, and/or molding processes (e.g., injection, vacuum, blow, etc.). In some implementations, the housing 104 can include an upper housing 101 and a lower housing 102.

The centrifugal separator 100 can receive blow-by gases from an engine at an inlet 110. The inlet 110 can be located anywhere on the housing 104 and can provide access to the inside of the housing 104. In certain implementations, the centrifugal separator 100 can include multiple and/or alternative inlets 110. The presence of additional inlets 110 can provide flexibility in installation of the centrifugal separator 100 within an engine bay. Conveniently, the inlet 110 can be located in the lower housing 102, such as on a bottom or side surface thereof. Various embodiments include a liquid outlet 112 and one or more air outlets 114, 114A, 114B. Additionally the inlet 110 can contain a pressure bypass valve 180 to vent pressure in the event the separator is unable to process the volume of gasses present exiting the crankcase.

Figure 3:
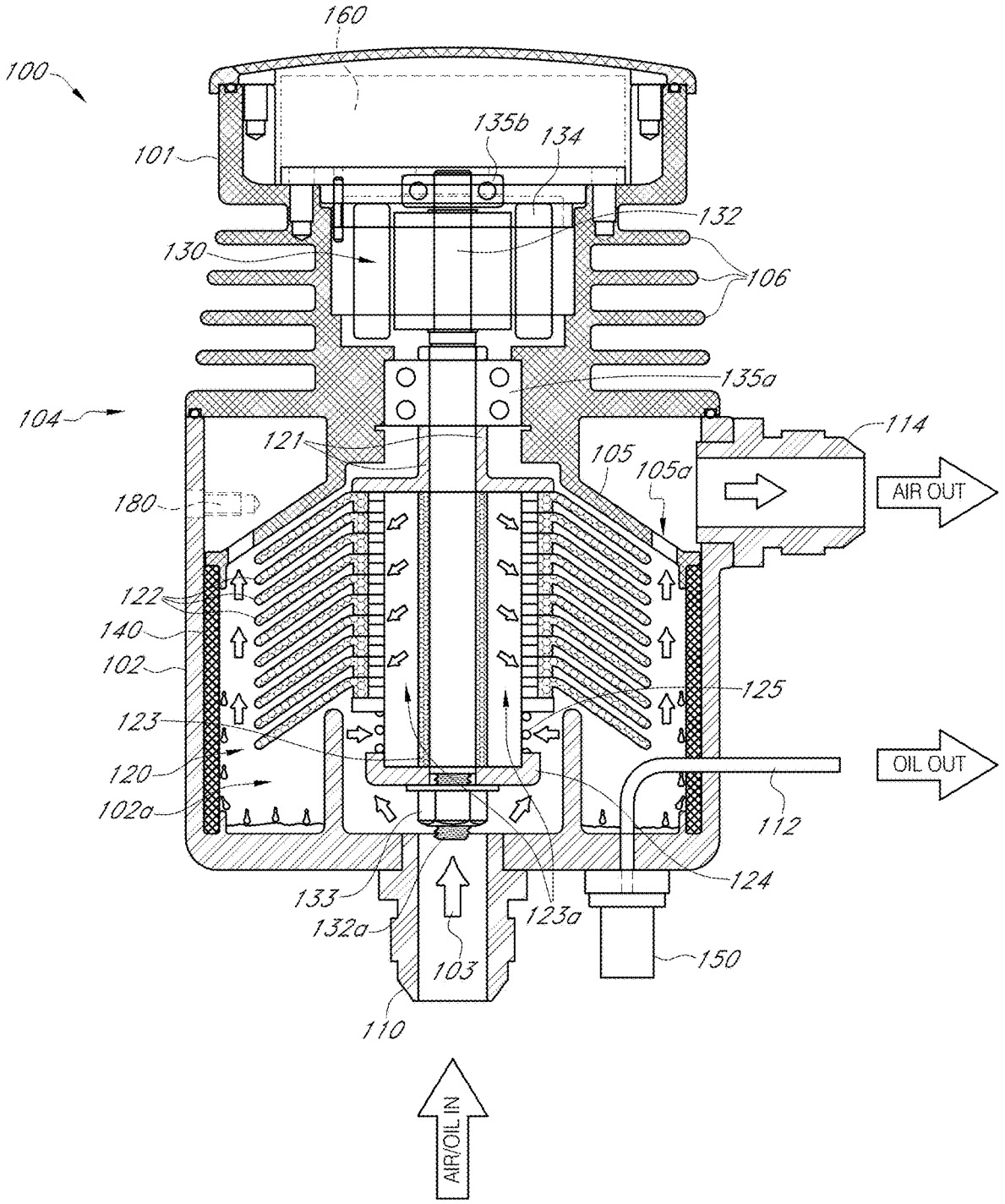
FIG. 3 is a cross-section of the centrifugal separator of FIG. 2B taken along the line A-A.

As shown in FIG. 3, the blow-by gases can proceed along a fluid path 103 through the centrifugal separator 100. The fluid path 103 can exit the housing 104 at an air outlet 114. In certain implementations the centrifugal separator 100 can include multiple air outlets 114A, 114B. Which air outlets are used can based on the geometry of the desired installation location. The air outlets can thus provide additional installation options for the centrifugal separator 100 in an engine bay. In some embodiments, the air outlets not being used are closed-off, such as with a cap.

As will be discussed in more detail below, the fluid path 103 can pass through a centrifuge 120 for separating the blow-by gases into air and liquid (e.g., oil and/or water). The lower housing 102 can include a chamber 102*a* for housing the centrifuge 120. The centrifuge 120 can comprise a plurality of stacked discs 122. As illustrated, in some embodiments, the disc 122 can comprise a radially tapered shape. A driver 123 can provide support to the stacked discs 122. One or more passages 123*a* can extend through (e.g., along the length of) the driver 123. In some embodiments, the passage 123*a* is positioned at a radial center of the driver 123. The stacked discs 122 can be stacked such that an air space exists between adjacent discs. The fluid path 103 can extend through the passages 123*a* of the driver 123 and through the air spaces between adjacent stacked discs 122. In some implementations, the fluid path 103 can extend into the passages 123*a* from a bottom of the driver 123 and extend upwards, providing access to one or more of the air spaces between the stacked discs 122.

The centrifuge 120 can be coupled with a motor 130. The motor 130 can spin the centrifuge 120 at high speed. In some implementations, the centrifuge 120 can be spun at least approximately 10,000 RPMs (rotations per minute). In certain implementations, or depending upon engine loads, the centrifuge 120 can rotate between 5,000 and 8,000 RPMs, 5,000 and 10,000 RPMs, or between 8,000 and 10,000 RPMs. In practice speeds may be adjusted between 0 RPMs and maximum RPM depending upon the needs of the system. As the centrifuge 120 is spun and the blow-by gases pass through the centrifuge 120 along the fluid path 103, the liquid in the blow-by gases can coalesce on the outer surfaces of the stacked discs 122. In several embodiments, as the blow-by gases proceed (e.g., radially outward) along the fluid path 103 between adjacent discs of the stacked discs 122, the proximity and/or turbulence created by the spinning discs can cause the liquid to separate from (e.g., fall out of) the air and onto the surfaces of the stacked discs 122. The blow-by gas, having been cleaned of at least some or most of the liquid, can proceed along the fluid path 103 as cleaned air. The cleaned air can proceed out of the centrifugal separator 100 at the air outlet 114. In some implementations, the air outlet 114 can connect with a conduit (e.g., a hose) that recirculates the air through the engine (e.g., delivers the air to the intake manifold).

The motor 130 can include a rotor shaft 132. The rotor shaft 132 can be disposed within a stator 134. The stator 134 can be in the upper housing 101. The upper housing 102 can include a plurality of fins 106. The fins 106 can be adjacent (e.g., radially) to the stator 134. The fins 106 can be used to radiate heat generated by the motor 130 out of the housing 104. The size and number of fins 106 can be selected based on the heat-dissipating requirements of the centrifugal separator 100.

The rotor shaft 132 can extend from the upper housing 101 to the lower housing 102. The rotor shaft 132 can couple with the driver 123 and provide rotation to the centrifuge 120. The rotation (e.g., angular acceleration and/or speed) of the stacked discs 122 can be controlled by the motor 130. The rotor shaft 132 can be supported by the housing 104 by one or more bearings 135*a*, 135*b*. For example, as illustrated, the bearings 135*a*, 135*b* can be mounted on opposite sides of the stator 134 to provide support for the rotor shaft 132 during rotation. In some implementations, a bearing (not shown) can be included on a lower end 132*a* of the rotor shaft 132. The bearings 135*a*, 135*b* can provide a stable axis of rotation for the rotor shaft 132 and/or the centrifuge 120.

The motor 130 can be any type of motor (e.g., DC, AC or other). In some implementations, the motor 130 is a brushless type motor. A brushless type motor typically does not produce sparks, which can reduce the likelihood and risk of combustion in the oil-rich environment within the centrifugal separator 100. The power specifications of the motor 130 can be selected such that it can operate the centrifuge 120 at the desired rate of rotation. In various embodiments, the centrifuge 120 is driven separately from the engine, such as not including a power take-off from the engine. This can increase the flexibility of locations for placement of the centrifugal separator 100 within an engine bay.

The lower end 132*a* of the rotor shaft 132 of the motor 130 can be coupled with a support 124. The support 124 can provide support to the driver 123. The lower end 132*a* can be threaded and/or extend through the support 124 and be secured thereto, such as by a nut 133. The lower end 132*a* and/or the nut 133 can be spaced away from the housing 104 to allow rotation of the centrifuge 120. In some implementations, the lower end 123*a* can be engaged with the housing 104 (e.g., through a bearing or directly).

A biasing member, such as a spring 125, can be disposed on, or in contact with, the support 124. The spring 125 can be wrapped at least partially around a portion of the driver 123. The spring 125 can bias and/or contact at least one of the stacked discs 122. The spring 125 can provide a force on the stacked discs 122 to keep the stacked discs in contact with each other and/or to otherwise position the stacked discs 122 on the driver 123. The spring 125 can be a coil spring or wave spring made from, for example, steel. The spring 125 can bias the plurality of discs 122 to force the discs together, such as to take up manufacturing (e.g. stack-up) tolerances. In certain implementations, the spring can be included be above the stacked discs 122, between adjacent discs 122, etc.

The housing 104 can include an upper support flange 121. In some implementations, the support flange 121 can be coupled with the housing 104 for maintaining the position of the centrifuge 120. In some implementations, the support flange 121 is coupled with the driver 123 and rotates therewith. The rotor shaft 132 can extend through the upper support flange 121. As illustrated, the support flange 121 can comprise one or more generally L-shaped cross-sections. The support flange 121 can block an upper end of the one or more central passageways 123*a* in the driver 123. In some implementations, a top portion of the driver 123 can block the one or more central passageways 123*a*. This can force the blow-by gases along the fluid path 103 and into the air spaces between adjacent discs of the stacked discs 122.

Some implementations include a plurality of apertures (not shown) through one or more of the stacked discs 122. The apertures can provide for air flow longitudinally between (e.g., vertically) adjacent air spaces that are located between adjacent discs of the stacked discs 122. In this manner, the blow-by gases can pass between adjacent air spaces. For example, each adjacent pair of stacked discs 122 can include one, two, three, four, or more apertures providing a passage way for the air flow.

The lower housing 102 can include a roof or upper section 105. The upper section 105 can at least partially bound the chamber 102*a* of the housing 104. The chamber 102*a* can be generally cylindrical in shape, although this is not required. The upper section 105 can provide support to the upper support flange 121, the rotor shaft 132 and/or the driver 123 such that the stacked discs 122 can rotate easily within the chamber 102*a*. One or more vents 105*a* through the upper section 105 can allow cleaned air from the centrifuge 120 to follow the fluid path 103 to the air outlet 114. In some implementations, the air outlet 114 is located within the chamber 102*a*.

The chamber 102*a* can include a wicking material 140. The wicking material 140 can at least partially cover an inner circumferential wall of the chamber 102*a*. The wicking material 140 can be generally aligned (e.g., longitudinally) with an outer edge of the stacked discs 122. As the liquid from the blow-by gases coalesces onto the stacked discs 122, the rotational acceleration of the centrifuge 120 can eject the liquid outwards, such as radially outward. The wicking material 140 can receive and absorb the liquid from the stacked discs 122. The wicking material can inhibit or prevent splashing and/or vaporizing of liquid back into the cleaned air. The wicking material 140 can be a fibrous material, such as natural fibers (e.g., felt, vegetable fibers, cellulose fiber or other), synthetic fibers, polyester batting, fiberglass, fish paper, NOMEX® fibers, non-asbestos sheeting, asbestos sheeting, ceramic fiber, or otherwise. In some embodiments, the wicking material 140 facilitates the liquid being drawn downward, such as by gravity. In certain implementations, the wicking material 140 inhibits or prevents the liquid from being drawn upward, such as toward a top of the separator 100.

In some embodiments, the liquid separated by the centrifuge 120 moves down through the wicking material 140 and/or along the sides of the chamber 102*a*. The liquid can move, for example, under the force of gravity. The liquid can drain into an oil reservoir. The oil reservoir can be a bottom of the chamber 102*a*. In certain embodiments, another reservoir comprises a receptacle attached to the lower housing 102 for receiving and storing the liquid.

The liquid can be removed from the chamber 102*a* through the liquid outlet 112. The liquid outlet 112 can be coupled by a conduit (e.g., a pipe) to the engine for recirculating the collected oil and water back to the engine, such as to the crankcase. In some embodiments, the liquid is recirculated by gravity. In some implementations, a pump 150 can be used to drive the liquid. For example, the pump 150 can raise elevation of the liquid being returned to the engine from the liquid outlet 112. The pump 150 thus increases the variety of optional installation positions within the engine bay for the centrifugal separator 100. This provides a substantial benefit and can facilitate installation within a cramped engine bay, or outside the engine bay. In some embodiments, the pump 150 is part of the separator 100. In certain embodiments, the pump 150 is a separate component from the separator 100 and can be located remote from the separator 100.

The centrifugal separator 100 can include a controller 160. The controller 160 can be integrated within the housing 104 or it can be separate therefrom. The controller 160 can control operation of the motor 130 and/or the pump 150. For example, the controller 160 can turn on or off, route power to, and regulate the power to the motor 130 and/or the pump 150. The control module 160 can be programmable. For example, the control module 160 can include a user interface that allows a user to input commands and controls to modify the operation of the centrifugal separator 100, as described further below. The user interface, for example, can be a computer, smart phone, other user input device connected with the control module 160 (e.g., either wired or wirelessly).

The housing 104 can include the pressure release valve 180. The pressure release valve 180 can be built into the gases inlet 110, as shown in FIGS. 2A, 2B. Alternatively, the pressure release valve can be in the housing 104 (e.g., in a sidewall thereof as shown in FIG. 3), in the air outlet 114, or any other suitable location. The pressure release valve 180 can inhibit or prevent excessive buildup of pressure within the housing 104. Excessive pressure can occur, for example, when the centrifugal separator 100 is unable to process the blow-by gases quickly enough, or if there is a blockage along the fluid path 103 or elsewhere within the housing 104. Excessive pressure can also come from the crankcase. Excessive crankcase pressure can be a sign f a worn engine. Regardless of the source, excessive pressure should be relieved before redelivering air to the engine in order to reduce the chance of the engine seals being forced out of the proper position.

In some embodiments, the pressure release valve 180 can include a breather filter. This allows the blow-by gases to be vented directly to the atmosphere and still follow relevant regulations. The pressure release valve 180 can thus offer a temporary or alternative solution to cleaning blow-by gases and thus increases the flexibility and range of applications for centrifugal separator 100 in the automotive accessory aftermarket and for manufacturers of original engines. The breather filter can be positioned in addition to or in the place of the air outlet 114.

In some implementations, the rotation of the centrifuge 100 can draw the blow-by gases into the housing 104 (e.g., through the inlet 110). In some implementations, the blow-by gases can be routed to the inlet 110 under a positive pressure (relative to atmosphere or the intake manifold of the engine) from leakage and buildup of blow-by gases within the crankcase of the engine. The positive air pressure can move along the fluid path 103. The housing 104 can be structured so that the fluid path 103 is the only natural pathway for the blow-by gases through the centrifugal separator 100. For example, the chamber 102*a* can include one or more upright members 102*b* that can substantially inhibit or prevent the blow-by gases from circumventing passage through the stacked discs 122. The upright members 102*b* can extend to adjacent or into contact with the lowermost disc of the stacked discs 122.

The discs 122 can be oriented with a concave side facing downwards or toward the blow-by gases passing to the central passages 123*a*. This configuration forces the blow-by gases following the path through the stacked discs 122 to change direction. As the blow-by gases change direction, they come into contact with the surfaces of the discs. This can create turbulence and/or cause the liquid constituent of the blow-by gases to coalesce on the surfaces of the discs. Due to centrifugal force, the weight of the liquid on the spinning disc 122 becomes much heavier than it would be under normal conditions under the force of gravity alone. This can force the liquid toward an outer edge of the discs 122. The centrifugal force on the liquid that has gathered on the discs can become orders of magnitude higher than gravity as the discs 122 spin. In various embodiments, the liquid is ejected from the outer edge of the discs 122. The wicking material 140 can act as a sponge to collect liquid and drain it downward towards the oil reservoir.

Figure 4:
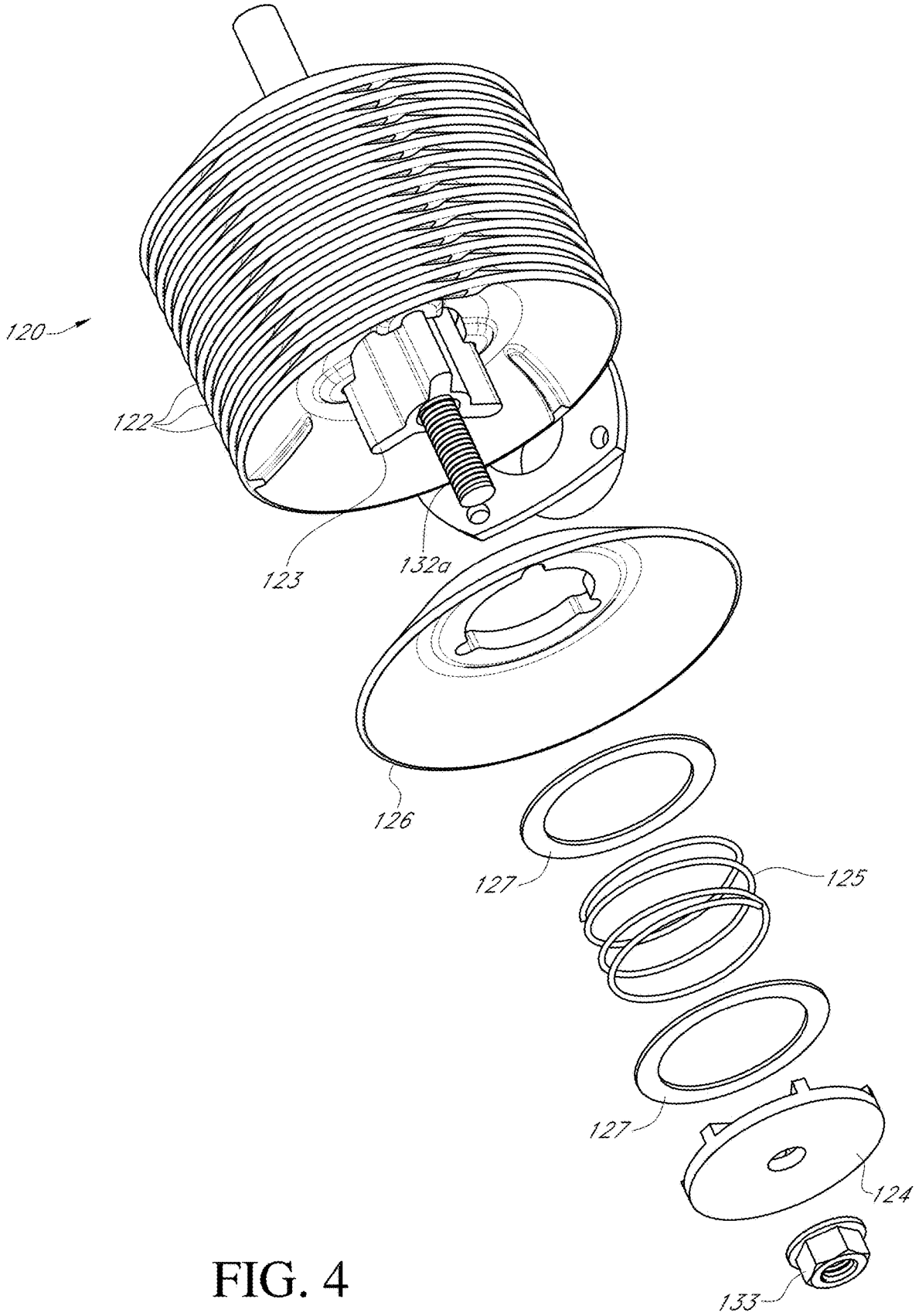
FIG. 4 is an exploded perspective view of a centrifuge assembly of the centrifugal separator of FIG. 2A.
Figure 5:
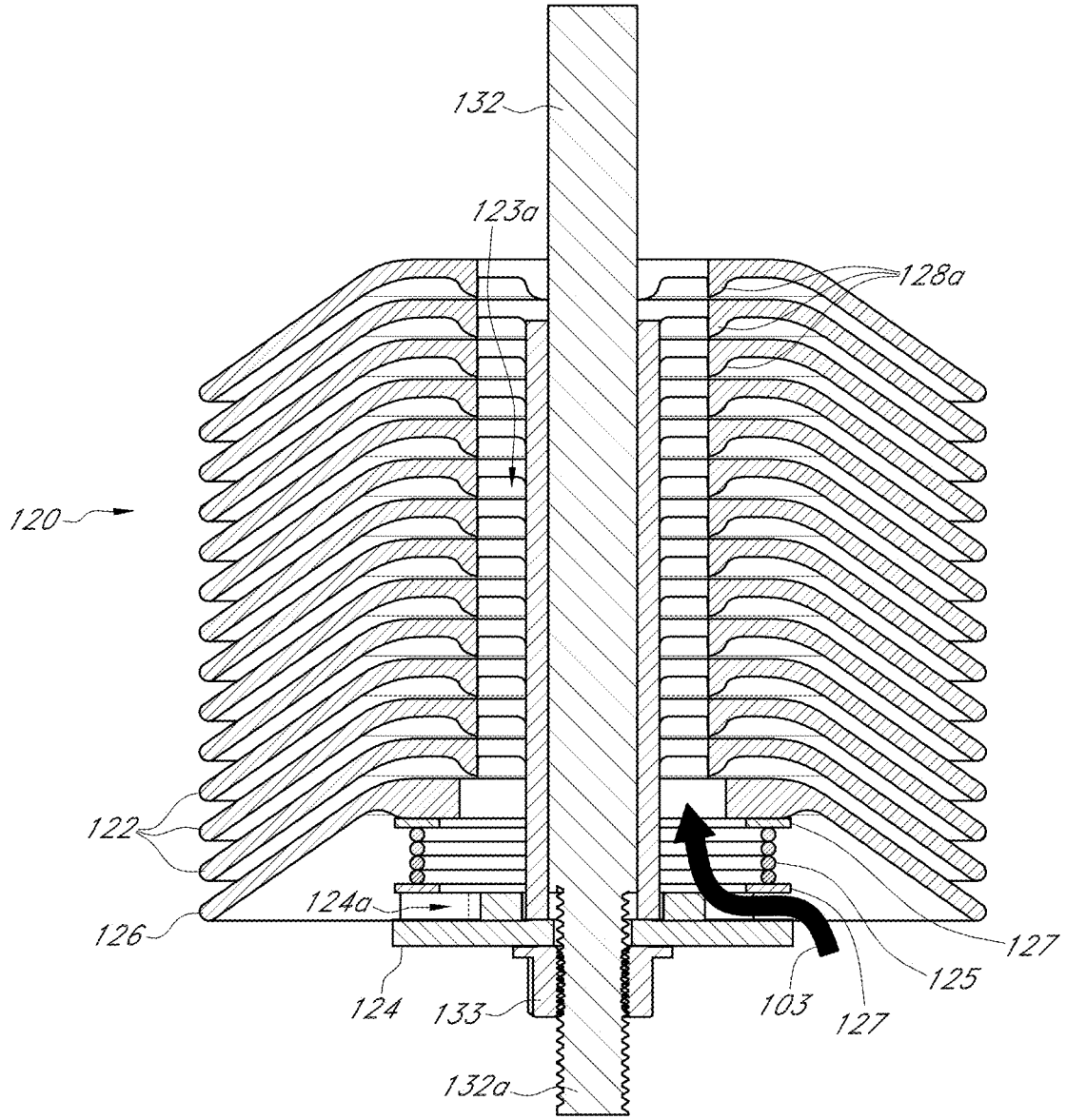
FIG. 5 is a cross-section of the centrifuge assembly of FIG. 4.

FIGS. 4-5 illustrate further detail of the centrifuge 120 having the plurality of stacked discs 122. The stacked discs 122 can be disposed over the rotor shaft 132 extending from the motor 130. The rotor shaft 132 can extend through the driver 123. The lower end 132*a* of the rotor shaft 132 can extend through the base support 124. The nut 133 can secure the lower end 132 with the base support 124. In some implementations, the nut 133 can be substituted for another type of mechanical coupling (e.g., welding, cotter pin, or other). One or more shims 127 can be disposed on the rotor shaft 132, on the driver 123, and/or between the stacked discs 122. The spring 125 can be supported between the base support 124 and a lowermost disk 126 of the stacked discs 122. The shim 127 can be included between the spring 125 and the base support 124 or lowermost disk 126.

The fluid path 103 can pass through the central passages 123*a* of the drive 123 and between the stacked discs 122. The fluid path 103 can enter the central passages 123*a* at the base support 124. The base support 124 can include a plurality of vents 124*a* for allowing blow-by gases into the central passages 123*a*.

One or more of the stacked discs 122 can include one or more spacers 128*a*. The spacers 128*a* can facilitate stacking of the discs 122 and maintaining air spacings therebetween. In some implementations, the air spacings between the stacked discs 122 can be between 0.4 mm and 0.8 mm. In some implementations, the air spacing can be larger or smaller. The height of the spacers 128*a* can be selected based on the use-conditions, desired performance, and operation of the centrifuge 120.

The centrifuge 120 can comprise separate individual discs (i.e., the stacked discs 122) assembled together. In some implementations, the centrifuge 120 can comprise stacked discs 122 that are formed integrally while leaving the air spacings therebetween. For example, the stacked discs 122 can be connected with adjacent discs in a central region (e.g., at the spacers 128*a*). In some implementations, the number of stacked discs 122 of the centrifuge 120 can vary between two discs and up to ten or more discs. The number of discs can depend on the application and performance required of the centrifugal separator 100. For example, more discs may be required to effectively clean a larger volume of blow-by gases passing through the centrifugal separator 100. More discs may be required where the amount of liquid contained within the blow-by gases is higher and/or the amount of liquid to be removed out of the blow-by gases by the centrifuge 120 is a higher percentage. The size of the discs (e.g., a diameter) can be increased to accommodate and clean more blow-by gases through the centrifugal separator 100.

Figure 6A:
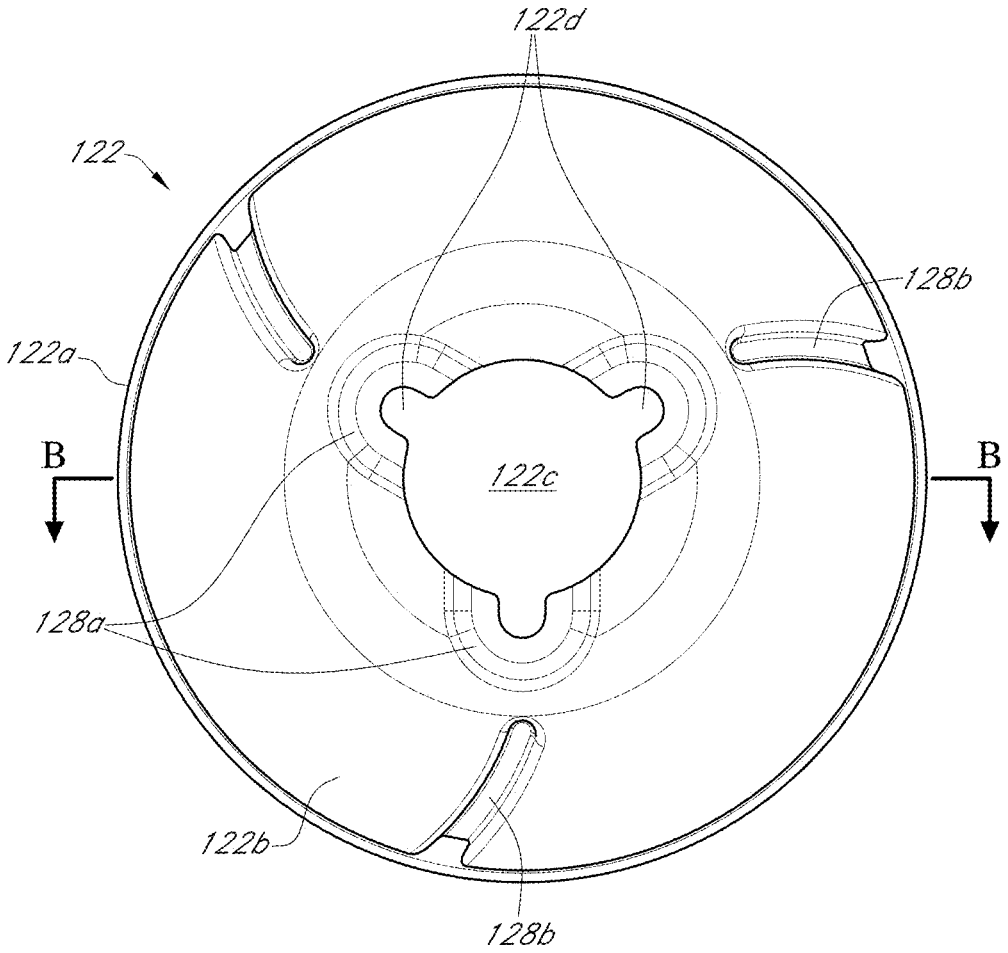
FIGS. 6A-6B are top, and cross-sectional views, respectively, of a disc of the centrifuge assembly of FIG. 4.
Figure 6B:
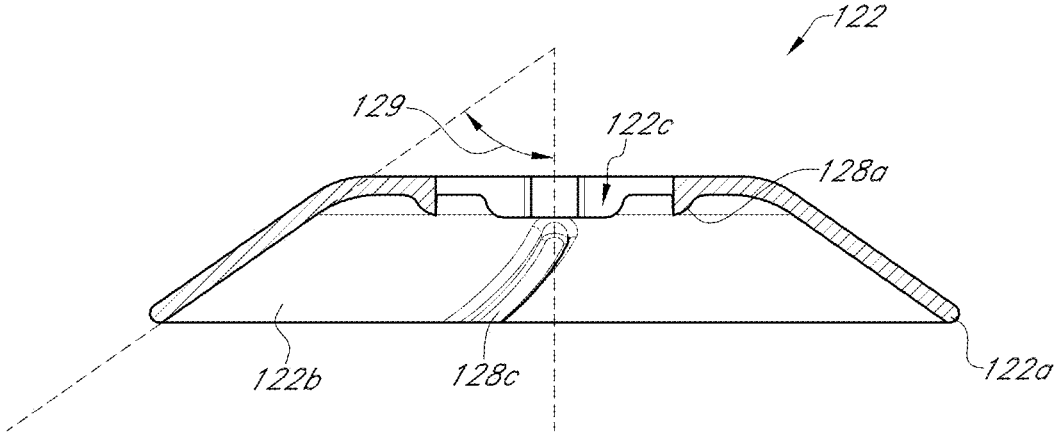

FIGS. 6A-6B show one of the discs of the plurality of discs 122. In some implementations, each of the stacked discs 122 can be identical. This arrangement can facilitate cleaning, replacement, and/or maintenance of the centrifugal separator 100. The stacked disc 122 has an outer edge 122*a*. The outer edge 122*a* can be the outermost circumferential edge of the disc 122. The stacked disc 122 of the centrifuge 120 can be generally conical, bowl-shaped, or substantially concave. An inner (e.g., concave) surface 122*b* can be oriented downwards or towards the incoming blow-by gases when assembled into the centrifuge 120. The inner surface 122*b* can comprise one or more flattened regions, as well as curved regions.

A central aperture 122*c* can extend through the disc 122. The central aperture 122*c* can be configured to receive the driver 123. In some implementations, there are one or more engagement grooves 122*d* for engaging with the driver 123 (e.g., at outer flanges 123*b* thereof, described below). This can enable the transfer of rotational force from the rotor shaft 132 to spin the stacked discs 122.

In some implementations, the stacked disc 122 can include one or more blades 128*b*. In some implementations, the blades 128*b* can be on the inner surface 122*b*. The blades 128*b* can aid in creating a vortex for drawing air through central passageways 123*a*. In some implementations, the blades 128*b* can be curved in the direction of intended rotation of the stacked discs 122. The blades 128*b* can aid in creating turbulent atmosphere for air passing between adjacent discs 122. This can facilitate the liquid and/or other contaminants contained within the blow-by gases to be deposited onto the discs 122. In some implementations, there can be multiple blades 128*b*. For example, there can be two, three, four, five, six, or more blades. The blades 128*b* can be spaced at even intervals around the circumference of the stacked disc 122. In some variants, the blades 128*b* serve as spacers between the stacked discs 122.

In some implementations, as shown in FIG. 6B, an outer flange region 122*e* of the stacked disc 122 can be set at an angle 129. In some implementations, the angle 129 can be between 0 and 90 degrees. In some implementations, the angle 129 can be approximately 45 degrees. In some implementations, the angle 129 can be between about 30 degrees and 70 degrees.

Figure 7:
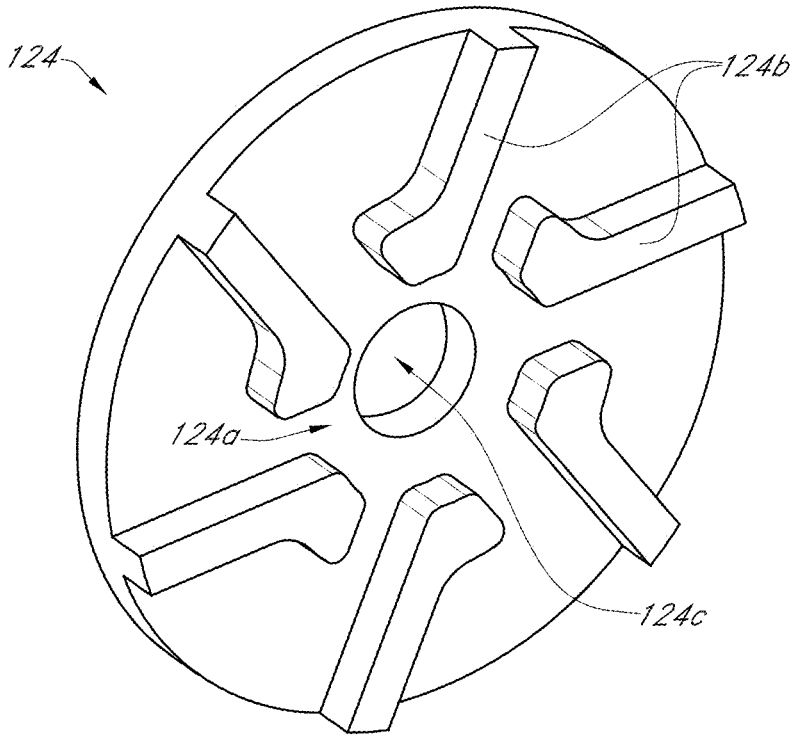
FIG. 7 is a perspective view of a base support of the centrifuge assembly of FIG. 4.

FIG. 7 shows the bottom support 124. The bottom support 124 can comprise one or more vents 124*a* for the fluid path 103. The vents 124*a* can be separated by flanges 124*b*. The flanges 124*b* can provide support to the spring 125. The driver 123 can interface with the bottom support 124. For example, the flanges 124 of the driver 123 can fit between the flanges 124*b* of the base support 124. This can aid in transferring rotational force between the driver 123 and the base support 124. The vents 124*a* can also be thereby aligned with the central passages 123*a*. The lower end 132*a* of the rotor shaft 132 can extend through a central aperture 124*c* of the base support 124.

Figure 8A:
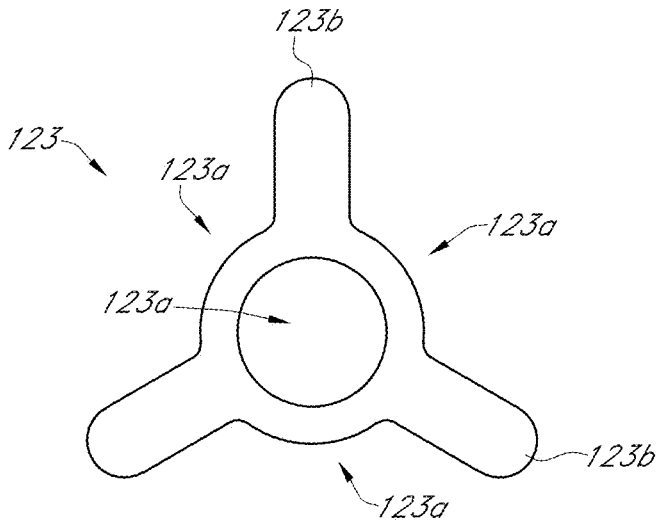
FIGS. 8A-8C are top, side, and perspective views, respectively, of a central driver of the centrifuge assembly.
Figure 8B:
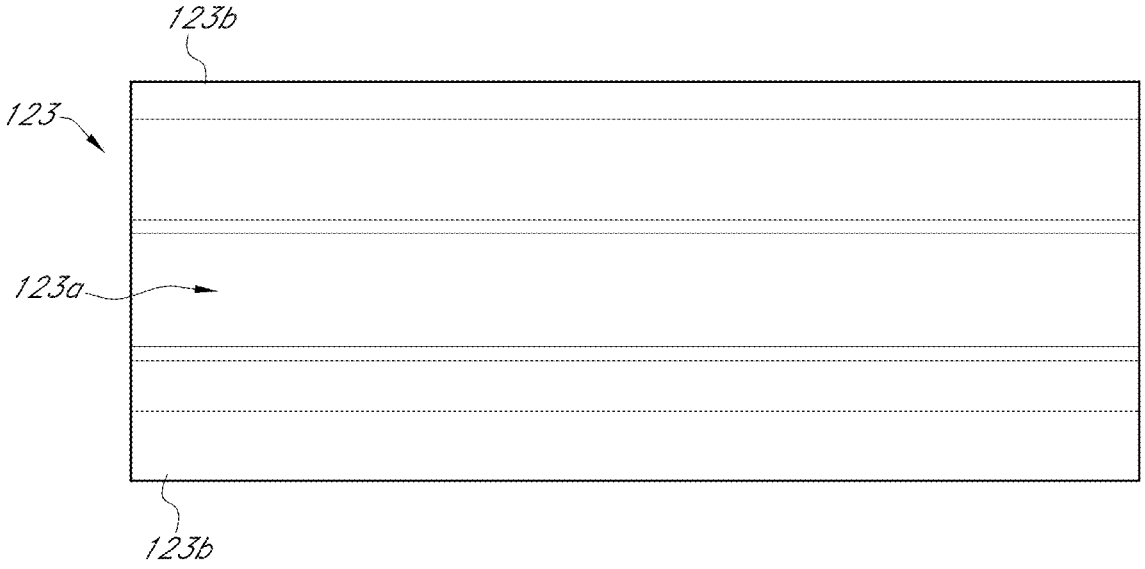
Figure 8C:
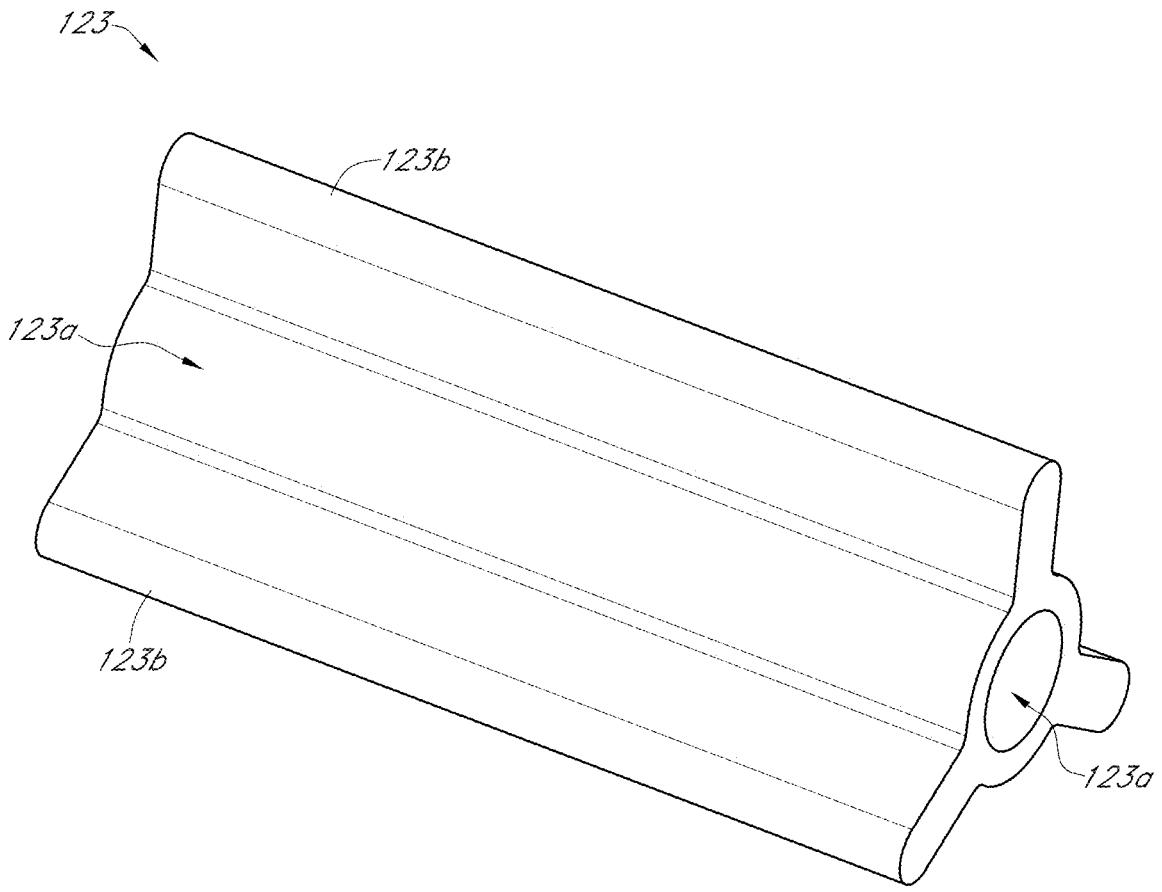

FIGS. 8A-8C show the driver 123. As shown, the driver 123 has more flanges 123*b* and the passages 123*a*. The illustrated driver 123 has three flanges. In certain implementations, there are fewer or more flanges 123*b* such as one, two, four, five, six, or more. The flanges 123*b* can be spaced evenly around the circumference of the driver 123. The flanges 123*b* can engage with the grooves 122*d* of each of the stacked discs 122. The central aperture 123*c* can be configured for receiving the rotor shaft 132. In some implementations, the rotor shaft 132 does not extend through the driver 123.

C. Centrifugal Separator System with Gravity Drain

Figure 9:
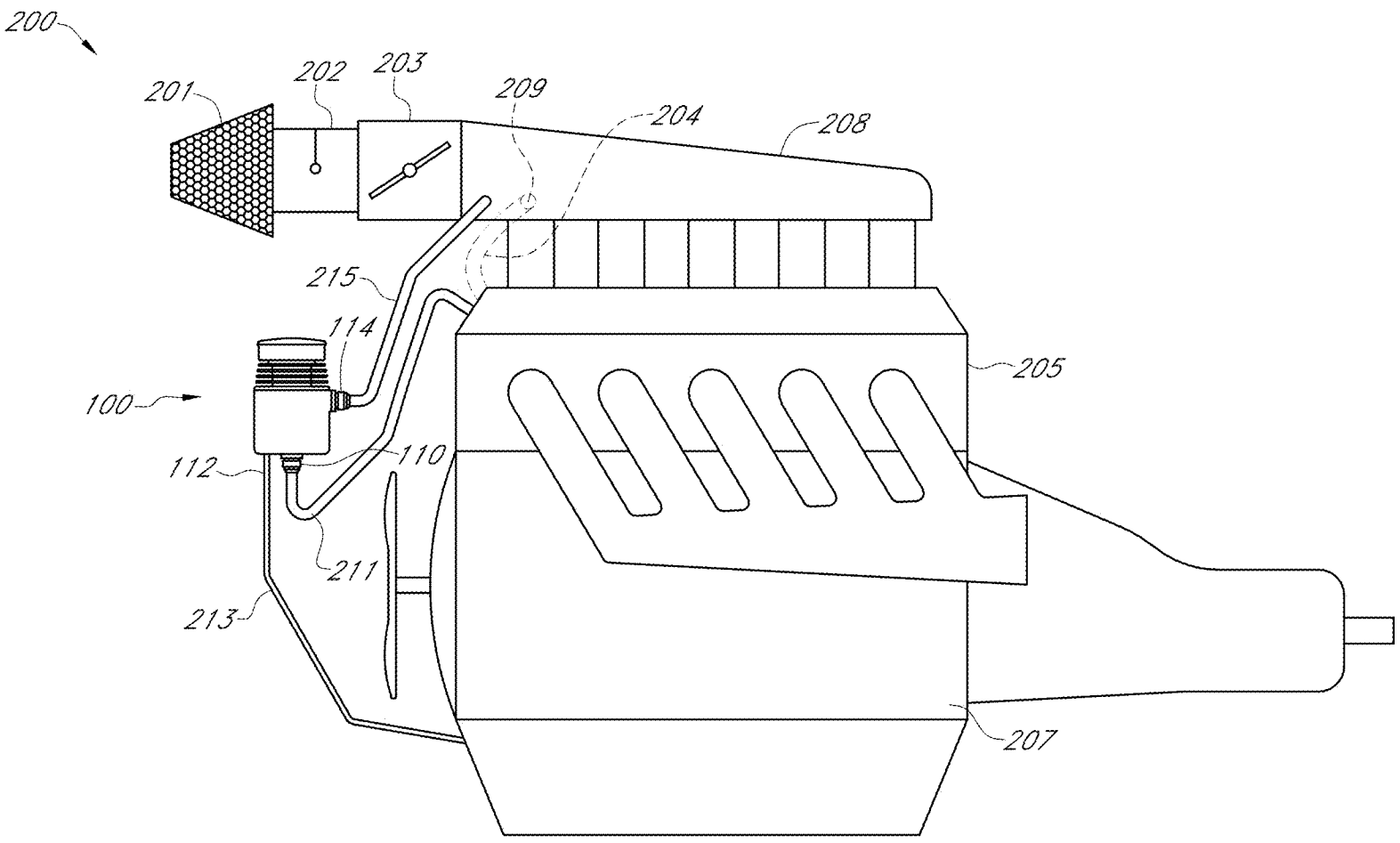
FIG. 9 is a schematic of the centrifugal separator installed in a normally aspirated engine.

FIG. 9 shows the centrifugal separator 100 in which liquid is drained by gravity back into the engine crankcase. In several embodiments, the engine is a normally aspirated (e.g., atmospheric pressure) gasoline engine 200. The engine 200 draws in atmospheric air through an air intake 201. The air intake 201 can include a filter or other filter-like media. After passing through the air intake 201, the air can be metered by a metering device such as a mass airflow sensor 202 and/or an air intake valve 203. The air can then enter the intake manifold 208 and is introduced into the intake ports of a cylinder head 205. With the addition of fuel, the air can be combusted within a cylinder of an engine block 206. The combustion process can cause blow-by gases to escape into the crankcase 207. In some arrangements, the blow-by gases can be returned to the intake manifold 208 through a port tube 204 (shown in dashed lines). Typically, the port tube 204 can be mounted to reroute the blow-by gases back into the air intake manifold 208 through a fitting 209. The port tube 204 can be mounted in a valve cover. In some implementations, the fitting 209 can include a check valve orifice to restrict the direction of amount or direction of flow above the port tube 204. This setup works in some engines because the intake manifold 208 is generally maintained at approximately atmospheric pressure in the normal aspirated engine 200 and the blow-by gases are at a relatively positive pressure (e.g., pressure created by force of combustion). However, this arrangement can be problematic in many engines. For example, in direct fuel injection engines, the liquid from the blow-by gases can foul the intake port valves of the cylinder.

The centrifugal separator 100 provides a better solution for processing blow-by gases. The blow-by gases from the engine 200 can be cleaned by the centrifugal separator 100. The cleaned air can be reintroduced into the intake manifold 208 and/or the separated liquid (e.g., oil and/or water) can be returned to the crankcase 207. This arrangement can provide substantial benefits, such as in terms of reducing oil deposits within the air intake of the engine 200 and inhibiting or preventing fouling.

The centrifugal separator 100 can be installed in an engine bay of the engine 200 or proximate thereto. Instead of routing the blow-by gases coming from the crankcase 207 through the port tube 204, the blow-by gases are fed into the centrifugal separator 100 through a blow-by gas tube 211. The blow-by gas tube 211 can couple with the inlet 110. The blow-by gases from the engine 200 can be fed through the centrifuge 120 of the centrifugal separator 100 as described above. The blow-by gases can be spun at high speeds and passed over a plurality of stacked discs 122 to separate the air into air and liquid. The cleaned air can exit the separator 100 at the outlet 114 and can then be fed through a breather tube 215 back into the intake manifold 208 through the entrance port 209. The liquid can be returned to the crankcase 207 through a gravity induced liquid return tube 213 that is coupled with the liquid outlet 112.

In certain implementations, the centrifugal separator 100 can be positioned and configured to allow for the liquid to be gravity-fed back into the engine 200. This reduces the maintenance and complexity required for the centrifugal separator 100 and can allow extended periods of time with minimal maintenance. As illustrated, the separator 100 is positioned at an elevation so that the outlet 112 is higher than the crankcase inlet. Thus, liquid can flow by gravity from the outlet 112 into the crankcase. In some embodiments, the separator 100 does not require or include a pump to deliver the liquid to the crankcase. In certain implementations, the separator 100 is positioned in the engine bay of the engine and configured to gravity drain liquid to the crankcase.

D. Centrifugal Separator System with Non-Gravity Drain

Figure 10:
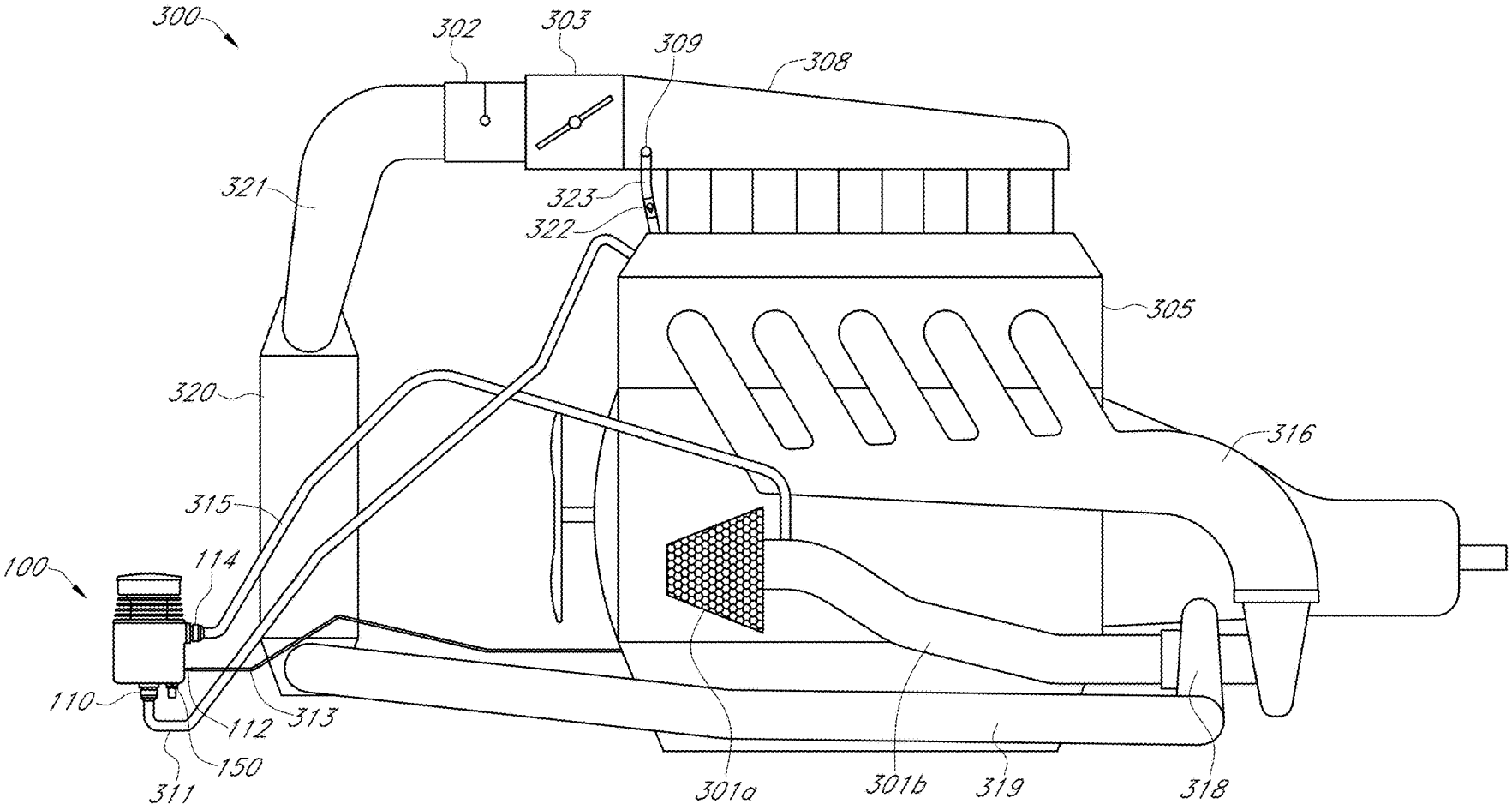
FIG. 10 is a schematic of the centrifugal separator installed in a turbocharged engine.

With current trends in the automotive industry moving towards more forced induction intakes, many vehicles are being highly modified to double or even triple the power output. A front runner in this regard includes a gas driven supercharger or turbocharger. These create many issues for the engineer in dealing with blow-by gases from the crankcase. FIG. 10 illustrates an installation of the centrifugal separator 100 in which the liquid is pumped back into the engine crankcase. In several embodiments, the engine is a turbocharged engine 300. Although described below in terms of a turbocharger, the system below can likewise be utilized in a supercharge engine or other type of engine. Moreover, in various engine types, the system disclosed herein can be implemented within tightly cramped engine bays and provides a plurality of mounting locations for the centrifugal separator 100.

The engine 300 can include an air intake 301*a* and an air filter. The air intake 301*a* can lead to an intake pipe 301*b* before a turbocharged compressor 318. The turbocharged compressor 318 can be coupled with an exhaust manifold 316 of the engine 300. The exhaust manifold 316 can channel exhaust of the engine 300 past a turbine operating the compressor 318. When operated, the compressor 318 can increase pressure of the intake air within a boost pipe 319. The boost pipe 319 can carry the compressed intake air 301*a* to an intercooler 320. The intercooler 320 reduces most of the heat of compression from the compressed intake air 301*a*. The compressed intake air exits the intercooler 320 by way of an exit tube 321. The exit tube 321 can route the compressed intake air into a mass airflow sensor 302 and/or through a valve 303. In some implementations, the mass airflow sensor 302 can be just after the air filter at the intake 301*a* on the suction side of the intake pipe 318. The compressed intake air can be received within an intake manifold 308. This arrangement is referred to as a blow-through system. This system can yield a quick response because the mass airflow sensor 302 is located close to the engine's intake manifold 308.

The compressed intake air is received within the cylinder head 305 and combusted (with fuel) within cylinders of a block 305. Blow-by gases can escape into a crankcase 307 due to the combustion, high amounts of pressure (from compression and the compressed intake air) in the cylinders, and/or worn seals. In some implementations, the blow-by gases can be fed back into a valve 309 of the intake manifold 308 through a draw tube 323 having a check valve 322. However, because of the higher pressure within the intake manifold from the compressor 318, this may not be possible when under boost.

Instead, the blow-by gases can be fed through a gas tube 311 to the centrifugal separator 100. The centrifugal separator 100 can separate the blow-by gases into air and liquid. The liquid can be returned through a liquid line 313 to the crankcase 307. Depending on the location of the centrifugal separator 100, the pump 150 may be used to drive the liquid. FIG. 10 illustrates a mounting arrangement where the centrifugal separator 100 is low within the engine bay. For example, the separator 100 can be located low within the engine bay or within an another space of the vehicle, such as within a fender, wheel well, or other location that is convenient within the vehicle. As illustrated, the outlet 112 of the separator 100 can be lower than the crankcase.

When under boost, pressure in the intake manifold 308 is higher than the ambient pressure and/or the pressure within the centrifugal separator 100. However, the clean air from the centrifugal separator 100 can be returned back through the intake side of the compressor 318 by an air return pipe 315. The air return pipe 315 can couple with the air intake 301*a* or intake pipe 301*b* (rather than the intake manifold 308). The return air pipe 315 may be mounted as to perform as a venture or other means to promote flow back into the air pipe 318.

E. Centrifugal Separator System Controls

Figure 11:
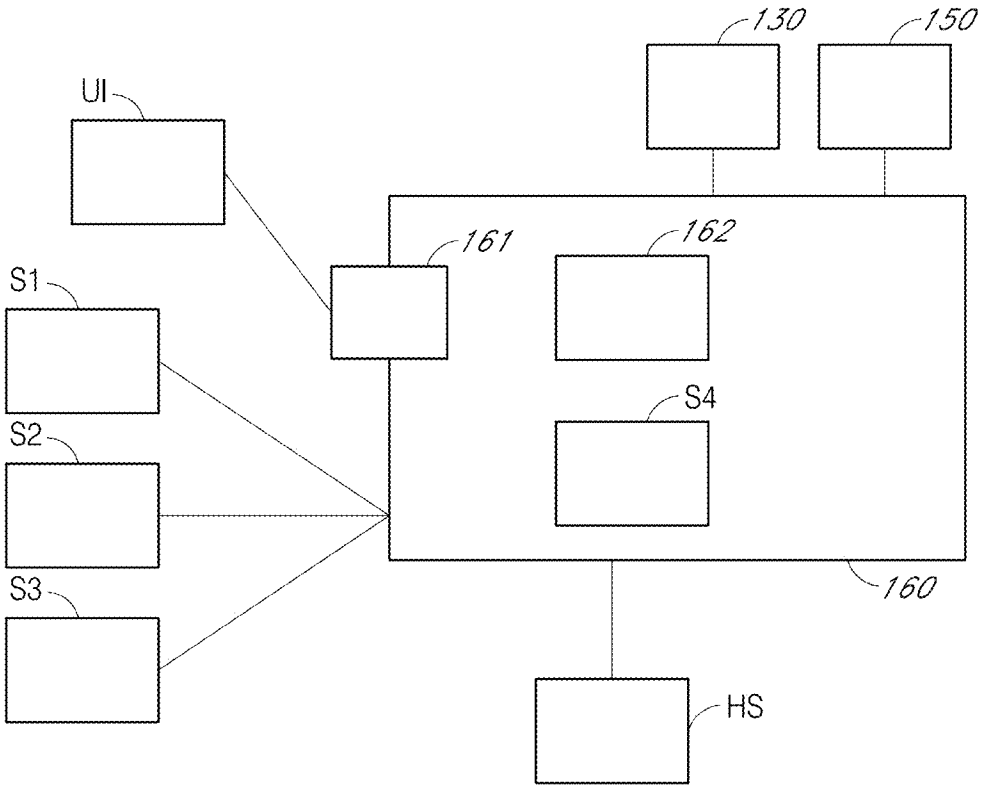
FIG. 11 is a schematic of a controller of the centrifugal separator.

As mentioned above, operation of the centrifugal separator 100 can be controlled by the controller 160. A schematic of the controller 160 is illustrated in FIG. 11. The controller 160 can be communicatively coupled with a user interface UI such as a laptop, smart phone, or other dedicated input device. The user interface UI can be wired or wirelessly connected. For example, the controller 160 can include a port 161. The port 161 can either be a physical connector (e.g., USB programming port) and/or a wireless interface (using BLUETOOTH® or other wireless standards). In some embodiments, the controller 160 comprises a transceiver.

The user interface UI can allow a user to program the controller 160 to operate the centrifugal separator 100. The user input can include selecting one or more operational parameters that can trigger the operation of the centrifugal separator 100 (e.g., rotation of the motor 130, operation of the centrifuge 120 and/or operation of the pump 150). The operational parameters can include, for example, any of a manifold air pressure, an engine speed trigger, any of the onboard diagnostic system (OBD) parameters that are used control and monitor the engine and related systems, or a timer or other input parameter.

The controller 160 can be coupled with one or more sensors, such as sensors S1-S4. The controller 160 can receive a signal from the one or more of the sensors S1-S4. For example, the sensor S1 can be a manifold air pressure sensor, the sensor S2 can be an engine speed sensor, sensor S3 can be the OBD system, and/or sensor S4 can be a timer. Based on said signal and the user input, the controller can operate the centrifugal separator 100.

A microcontroller 162 (e.g., a processor and a memory) of the controller 160 can receive the user input from the user interface UI. The microcontroller 162 can receive the signal from one or more of the sensors S1-S4 and process it at least partially based on and/or in response to the user input. For example, the operational parameters can include trigger thresholds and the microcontroller 162 can compare the signal from the corresponding sensor. Based at least in part on this comparison, the microcontroller 162 can start, stop, accelerate, decelerate, or otherwise modify operation of the centrifugal separator 100 or its component (e.g., the motor 130 and/or pump 150).

The controller 160 can be programmed through the user interface UI to receive a second operational parameter. The second operation parameter can be the same parameter as the operation parameter or a different parameter. The second operational parameter can correspond to, for example, a reduction in engine speed, a reduction in manifold air pressure, a timer, or other parameter from the onboard diagnostic system. The microcontroller 162 can compare the signal form the corresponding sensor with the second operation parameter. Based at least in part on and/or in response to this comparison, the microcontroller 162 can modify the operation of the motor 130 and/or pump 150. For example, the microcontroller 162 can modify the motor 130 operation by turning the motor on or off, changing speeds (e.g., current input), run time, or otherwise.

In certain implementations, the user can specify additional detail of the operation of the centrifugal separator 100. For example, user input can also include configuring the speed, acceleration, interval, and duration of the motor 130 and/or pump 150.

In some implementations, the controller 160 can operate the pump 150. For example, the pump 150 can be operated based on a timer. The timer (e.g., start time, stop time, run time or other) can be set by the user through the user interface UI. In some implementations, the controller 160 can be programed to operate the pump 150 in conjunction with the operation of the centrifugal separator 100. For example, the pump 150 can operate based on (e.g., a percentage of) the operation time of the motor 130. The percentage of the operation time of the motor 130 can be between 0 and 100%.

In some embodiments, the centrifugal separator 100 comprises a heat sensor HS. The heat sensor HS can be coupled with the centrifugal separator 100. For example, the heat sensor HS can be coupled on or proximate the motor 130. The motor 130 can generate substantial heat. To reduce the risk of overheating and damage to the motor 130 or other components of the centrifugal separator 100, the microcontroller 162 can receive a signal from the heat sensor HS. The microcontroller 162 can; slow, stop and/or prevent operation of the motor 130 and/or pump 150 based on the signal from the heat sensor HS being over a defined temperature threshold. In some implementations, the user can set the temperature threshold through the user interface UI.

In some implementations, the controller 160 can also transmit notifications and data about the operation of the centrifugal separator 100. For example, the controller 160 can transmit, and the user interface UI can display information about, the speed of the motor, the temperature of the temperature sensor, how long the pump has been operating, or other operational information. In some implementations, the centrifugal separator 100 can include a flow sensor. In certain embodiments, the flow sensor can be used to measure the amount of air that goes out of the centrifugal separator 100. The controller 160 can relay information from the flow sensor to the user interface. In some implementations, operation of the centrifugal separator 100 can be based at least in part on and/or in response to the signal from the flow sensor.

F. Methods of Operating a Centrifugal Separator System

Figure 12:
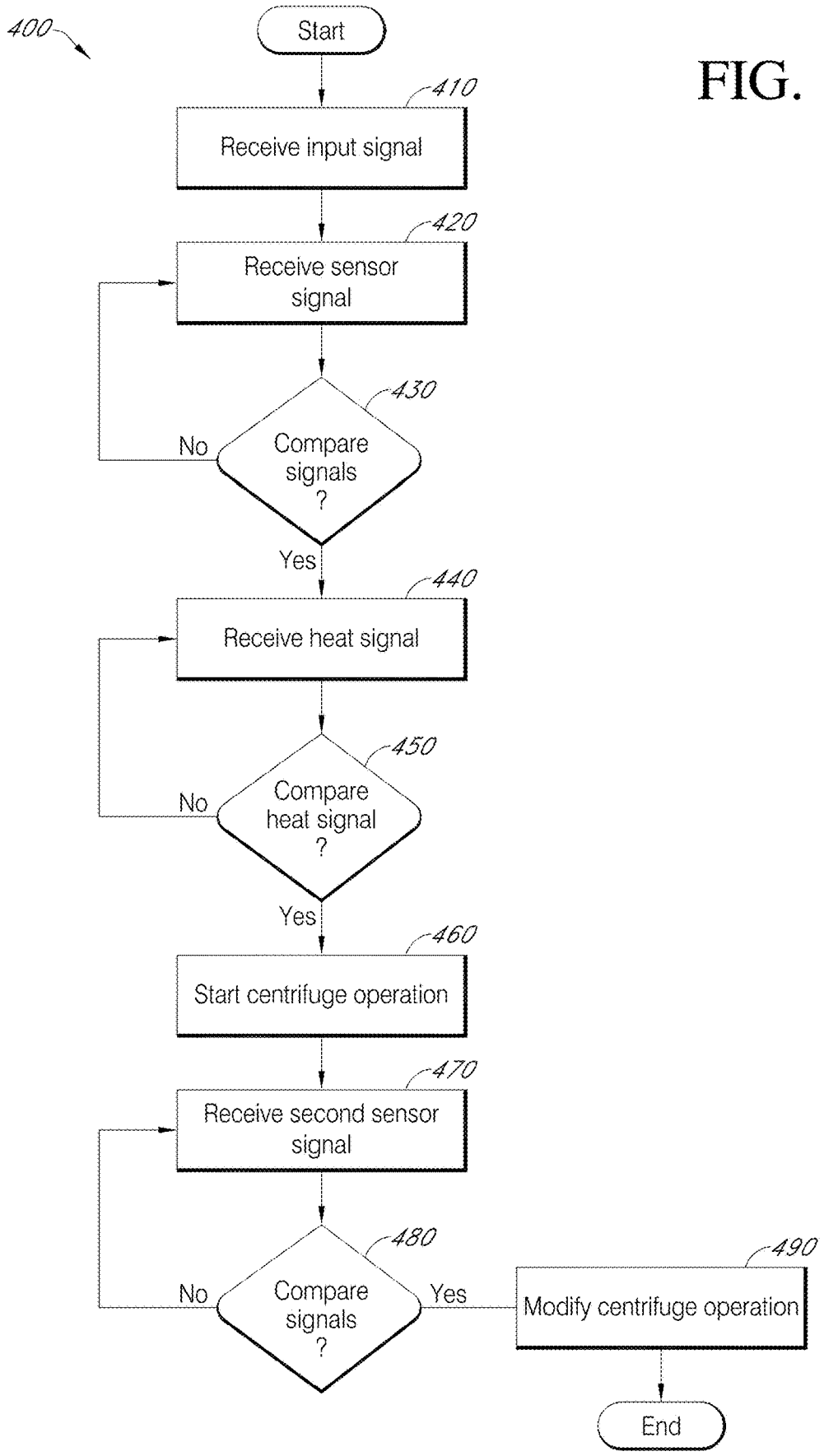
FIG. 12 is a flow chart showing a method of operating the centrifugal separator.

FIG. 12 illustrates a method 400 of operating the centrifugal separator 100. At block 410, the controller 160 of the centrifugal separator 100 can receive an input signal from the user interface UI. The input signal can program the microcontroller 162. The input signal can correspond to a selection by the user of the one or more operational parameters that can trigger the operation of the centrifugal separator 100. The selected operational parameters can include the intake manifold pressure, engine speed, a timer and/or another variable of the OBD system.

At block 420, the controller 160 can receive a sensor signal from one of the sensors S1-S4. For example, the sensor S1 can be a manifold air pressure sensor, the sensor S2 can be an engine speed sensor, sensor S3 can be the OBD system and/or sensor S4 can be a timer.

At block 430, the microcontroller 162 of the controller 160 can execute programming instructions to compare the sensor signal with the input signal. For example, the programming instructions can correlate the sensor signal with a pressure, speed, time or other variable. The programming instructions can correlate the input signal with a pressure, speed, time or other variable. The programming instructions can compare the correlated input and sensor signals to determine if a predefined condition is met. For example, the microcontroller 162 can compare the input and sensor signals to determine if a trigger or threshold condition is met to operating the centrifuge 120. If the predefined condition is met, the method 400 can continue to the next part of the method. If the predefined condition is not met, the microcontroller 162 can continue monitoring the sensors S1-S4.

At block 440, the microcontroller 162 can receive a heat signal from the heat sensor HS. The heat sensor HS can be embedded in, adjacent to, or on the motor 130.

At block 450, the microcontroller 162 can execute programing instructions to correlate the heat signal HS with a temperature. The microcontroller 162 can execute programing instructions to compare the temperature with a temperature threshold. The temperature threshold can be included in the input signal. If the temperature is below the temperature threshold, the method 400 can continue to the next part of the method. If the temperature is above the temperature threshold, the microcontroller 162 can continue monitoring the heat sensor HS. The heat sensor HS signal sent to the microcontroller 162 may be used to slow the acceleration or speed of the motor or to stop the motor altogether. The heat sensor HS is intended to perform as a safety device for protection of the motor. Blocks 440, 450 can optionally be performed before or at the same time as the Blocks 420, 430.

At block 460, the controller 160 can initiate operation of the centrifuge 120. The controller 160 can route power to the motor 130 and/or pump 150. The blow by gases can be drawn into the housing 104 at the inlet 110. The by-pass gases can flow through the centrifugal separator 100 along the fluid path 103 by positive pressure from an engine and/or a draw from rotation of the centrifuge 120. The centrifugal separator 100 can gather the separated liquid, such as within the chamber 102*a*. The liquid can be thrown by rotation from the stacked discs 122 and into the walls of the chamber 102*a*. The walls of the chamber 102*a* can include the fibrous material 140. The liquid can drip through the fibrous material 140 to gather at the bottom of the chamber 102*a*. The liquid can flow through the liquid outlet 112 to an engine. The liquid can flow under the force of gravity or with the aid of the pump 150. The controller 160 can operate the pump 150. For example, the pump 150 can be operated based on a timer and/or in conjunction with operation of the motor 130. The cleaned air can proceed along the fluid path 103 to the air outlet 114. The air outlet 114 can return the cleaned air to the engine. For example, the cleaned air can be returned to an air intake manifold or to the supply side of a turbocharged compressor intake system.

Optionally, the controller 160 can manage the acceleration and/or speed of the motor 130. In some embodiments, the input signal can program aspects of the operation of the centrifugal separator 100. For example, the input signal can configure the controller 160 to control the speed, acceleration, interval and duration of the motor 130 and/or pump 150.

At block 470, the controller 160 of the centrifugal separator 100 can receive a second sensor signal from one of the sensors S1-S4 or the heat sensor HS. For example, microcontroller 162 can monitor (e.g., continuously monitor) the sensors S1-S4 and/or the heat sensor HS. The user input can include instructions selecting the second sensor signal.

At block 480, the microcontroller 162 of the controller 160 can execute programming instructions to compare a correlated second sensor signal with the predefined condition and/or the temperature threshold. If the predefined condition and/or temperature threshold is met, the method 400 can continue to the next part of the method. If the predefined condition is not met, the microcontroller 162 can continue monitoring the sensors S1-S4 and heat sensor HS.

At block 490, the operation of the motor 130 can be modified, such as by stopping, speeding up, slowing the centrifuge 120 and/or other operations of the motor 130 and/or pump 150. The microcontroller 162 can include programming instructions to modify operation of the motor 130 and/or pump 150. The user input can include instructions for modification of operation of the motor 130.

G. Certain Terminology

Terms of orientation used herein, such as "top," "bottom," "proximal," "distal," "longitudinal," "lateral," and "end," are used in the context of the illustrated embodiment. However, the present disclosure should not be limited to the illustrated orientation. Indeed, other orientations are possible and are within the scope of this disclosure. Terms relating to circular shapes as used herein, such as diameter or radius, should be understood not to require perfect circular structures, but rather should be applied to any suitable structure with a cross-sectional region that can be measured from side-to-side. Terms relating to shapes generally, such as "circular," "cylindrical," "semi-circular," or "semi-cylindrical" or any related or similar terms, are not required to conform strictly to the mathematical definitions of circles or cylinders or other structures, but can encompass structures that are reasonably close approximations.

Conditional language, such as "can," "could," "might," or "may," unless specifically stated otherwise, or otherwise understood within the context as used, is generally intended to convey that certain embodiments include or do not include, certain features, elements, and/or steps. Thus, such conditional language is not generally intended to imply that features, elements, and/or steps are in any way required for one or more embodiments.

Conjunctive language, such as the phrase "at least one of X, Y, and Z," unless specifically stated otherwise, is otherwise understood with the context as used in general to convey that an item, term, etc. may be either X, Y, or Z. Thus, such conjunctive language is not generally intended to imply that certain embodiments require the presence of at least one of X, at least one of Y, and at least one of Z.

The terms "approximately," "about," and "substantially" as used herein represent an amount close to the stated amount that still performs a desired function or achieves a desired result. For example, in some embodiments, as the context may dictate, the terms "approximately," "about," and "substantially," may refer to an amount that is within less than or equal to 10% of the stated amount. The term "generally" as used herein represents a value, amount, or characteristic that predominantly includes or tends toward a particular value, amount, or characteristic. As an example, in certain embodiments, as the context may dictate, the term "generally parallel" can refer to something that departs from exactly parallel by less than or equal to 20 degrees.

H. Summary

Several illustrative embodiments of centrifugal separators and engine systems have been disclosed. Although this disclosure has been described in terms of certain illustrative embodiments and uses, other embodiments and other uses, including embodiments and uses which do not provide all of the features and advantages set forth herein, are also within the scope of this disclosure. Components, elements, features, acts, or steps can be arranged or performed differently than described and components, elements, features, acts, or steps can be combined, merged, added, or left out in various embodiments. All possible combinations and subcombinations of elements and components described herein are intended to be included in this disclosure. No single feature or group of features is necessary or indispensable.

Certain features that are described in this disclosure in the context of separate implementations can also be implemented in combination in a single implementation. Conversely, various features that are described in the context of a single implementation also can be implemented in multiple implementations separately or in any suitable subcombination. Moreover, although features may be described above as acting in certain combinations, one or more features from a claimed combination can in some cases be excised from the combination, and the combination may be claimed as a subcombination or variation of a subcombination.

Any portion of any of the steps, processes, structures, and/or devices disclosed or illustrated in one embodiment or example in this disclosure can be combined or used with (or instead of) any other portion of any of the steps, processes, structures, and/or devices disclosed or illustrated in a different embodiment, flowchart, or example. The embodiments and examples described herein are not intended to be discrete and separate from each other. Combinations, variations, and some implementations of the disclosed features are within the scope of this disclosure.

While operations may be depicted in the drawings or described in the specification in a particular order, such operations need not be performed in the particular order shown or in sequential order, or that all operations be performed, to achieve desirable results. Other operations that are not depicted or described can be incorporated in the example methods and processes. For example, one or more additional operations can be performed before, after, simultaneously, or between any of the described operations. Additionally, the operations may be rearranged or reordered in some implementations. Also, the separation of various components in the implementations described above should not be understood as requiring such separation in all implementations, and it should be understood that the described components and systems can generally be integrated together in a single product or packaged into multiple products. Additionally, some implementations are within the scope of this disclosure.

Further, while illustrative embodiments have been described, any embodiments having equivalent elements, modifications, omissions, and/or combinations are also within the scope of this disclosure. Moreover, although certain aspects, advantages, and novel features are described herein, not necessarily all such advantages may be achieved in accordance with any particular embodiment. For example, some embodiments within the scope of this disclosure achieve one advantage, or a group of advantages, as taught herein without necessarily achieving other advantages taught or suggested herein. Further, some embodiments may achieve different advantages than those taught or suggested herein.

Some embodiments have been described in connection with the accompanying drawings. The figures are drawn and/or shown to scale, but such scale should not be limiting, since dimensions and proportions other than what are shown are contemplated and are within the scope of the disclosed invention. Distances, angles, etc. are merely illustrative and do not necessarily bear an exact relationship to actual dimensions and layout of the devices illustrated. Components can be added, removed, and/or rearranged. Further, the disclosure herein of any particular feature, aspect, method, property, characteristic, quality, attribute, element, or the like in connection with various embodiments can be used in all other embodiments set forth herein. Additionally, any methods described herein may be practiced using any device suitable for performing the recited steps.

For purposes of summarizing the disclosure, certain aspects, advantages and features of the inventions have been described herein. Not all, or any such advantages are necessarily achieved in accordance with any particular embodiment of the inventions disclosed herein. No aspects of this disclosure are essential or indispensable. In many embodiments, the devices, systems, and methods may be configured differently than illustrated in the figures or description herein. For example, various functionalities provided by the illustrated modules can be combined, rearranged, added, or deleted. In some embodiments, additional or different processors or modules may perform some or all of the functionalities described with reference to the example embodiment described and illustrated in the figures. Many implementation variations are possible. Any of the features, structures, steps, or processes disclosed in this specification can be included in any embodiment.

In summary, various embodiments and examples of centrifugal separators and engine systems and related methods have been disclosed. This disclosure extends beyond the specifically disclosed embodiments and examples to other alternative embodiments and/or other uses of the embodiments, as well as to certain modifications and equivalents thereof. Moreover, this disclosure expressly contemplates that various features and aspects of the disclosed embodiments can be combined with, or substituted for, one another. Accordingly, the scope of this disclosure should not be limited by the particular disclosed embodiments described above, but should be determined only by a fair reading of the claims.

The following is claimed:

1. A centrifugal separator for processing blow-by gases from an internal combustion engine, the centrifugal separator comprising:

a housing defining an internal chamber having and inner wall;

a centrifuge comprising a plurality of stacked discs positioned in the chamber;

a motor coupled with the stacked discs and configured to rotate the stacked discs;

a controller for controlling operation of the motor and the rotation of the stacked discs, the controller configured for receiving an input operational parameter and configured to evaluate the input parameter against at least one sensor signal received by the controller, the sensor signal based on at least one of an intake manifold air pressure or an engine speed;

an inlet leading into the housing, the inlet positioned proximate to a bottom of the housing;

an air outlet leading out of the housing, the air outlet positioned above the inlet into the housing;

an oil outlet positioned proximate to a bottom of the housing;

a fluid path from the inlet, through the plurality of stacked discs, to the air outlet, the fluid path extending through a central passage of the plurality of stacked discs and between at least two adjacent discs of the plurality of stacked discs and toward the chamber inner wall to proceed away from the oil outlet and along the chamber inner wall to the air outlet;

a capture element of wicking material extending around the inner circumferential chamber wall and extending adjacent to the plurality of stacked discs and between the oil outlet and air outlet, the capacitive wicking material configured to intercept and capture oil ejected from the stacked discs and to draw it downwardly in the chamber proximate to a bottom of the housing;

a pump configured to operate independently of the centrifuge and rotating discs and coupled with the oil outlet for pumping oil out of the separator; wherein the separator is configured such that, during operation:

the controller operates the centrifuge and pump based on the evaluation of the input operational parameter against the at least one sensor signal;

the motor rotates the plurality of stacked discs;

the blow-by gases enter the separator through the inlet, pass through the fluid path, and flow between the at least two adjacent discs of the plurality of stacked discs;

oil in the blow-by gases forms on the least two adjacent discs and is ejected radially outwardly by the rotation of the discs toward the chamber inner wall to be captured by the capacitive wicking material and kept away from the fluid path along the chamber inner wall to the air outlet, the capacitive wicking material directing the captured oil to the bottom of the housing and the oil outlet thereby separating the blow-by gases into an oil portion and an air portion;

the oil portion is pumped, by the pump, out of the separator through the oil outlet; and the air portion flows out of the separator through the air outlet.

2. The centrifugal separator of claim 1, further comprising one or more heat fins on the housing for dissipating heat of the motor.

3. The centrifugal separator of claim 1, wherein the fibrous material is configured to prevent the oil from being drawn upwardly toward the air outlet.

4. The centrifugal separator of claim 1, wherein at least one stacked disc of the plurality of stacked discs includes one or more raised spacers for drawing the blow-by gases along the path through the centrifuge.

5. The centrifugal separator of claim 1, wherein the controller independently operates the motor based on the evaluation of the input operational parameter against the at least one sensor signal.

6. The centrifugal separator of claim 5, wherein the input operational parameter is selected through a user interface, the controller further configured for comparing the operational parameter input signal to the at least one sensor signal received by the controller for controlling the operation of the centrifugal separator.

7. The centrifugal separator of claim 1, wherein the input operational parameter comprises a parameter received from the onboard diagnostic system of the engine.

8. The centrifugal separator of claim 1, further comprising a temperature sensor configured to detect a temperature of the motor and provide a sensor signal to the controller, and wherein the controller is configured to control operation of the motor in response the detected temperature.

9. The centrifugal separator of claim 1, wherein the controller operates the pump based on one of an operational parameter selected through a user interface and operation of the motor.

10. The centrifugal separator of claim 1, further comprising a plurality of stacked discs that are angled in the housing toward the oil outlet and away from the air inlet.

11. The centrifugal separator of claim 1, at least one of the plurality of stacked discs includes a spacer for spacing the disc from an adjacent disc in the plurality of stacked discs.

12. The centrifugal separator of claim 8, wherein the controller is further configured to control the operation of the motor in response the detected temperature by at least one of slowing the acceleration or speed of the motor or stopping the motor.

* * * * *